US007739958B2

(12) United States Patent
Gordon

(10) Patent No.: US 7,739,958 B2
(45) Date of Patent: Jun. 22, 2010

(54) MULTI-TRACK MULTI-VEHICLE INTERACTIVE ROLLER COASTER

(76) Inventor: Jonathan I. Gordon, 4819 W. Braddock Rd., #11, Alexandria, VA (US) 22311

( * ) Notice: Subject to any disclaimer, the term of this patent is extended or adjusted under 35 U.S.C. 154(b) by 812 days.

(21) Appl. No.: 11/351,791

(22) Filed: Feb. 10, 2006

(65) Prior Publication Data

US 2007/0089631 A1 Apr. 26, 2007

Related U.S. Application Data

(60) Provisional application No. 60/729,619, filed on Oct. 24, 2005.

(51) Int. Cl.
*A63G 1/00* (2006.01)

(52) U.S. Cl. ..... 104/53

(58) Field of Classification Search ..... 104/53, 104/60, 62, 63, 67, 83–86
See application file for complete search history.

(56) References Cited

U.S. PATENT DOCUMENTS

| | | | | |
|---|---|---|---|---|
| 142,605 | A | 9/1873 | Yates | |
| 803,465 | A | 10/1905 | Bernheisel | |
| 815,211 | A | 3/1906 | Pattee et al. | |
| 953,459 | A | 3/1910 | Cleghorn | |
| 2,196,093 | A | 4/1940 | Bartlett | |
| 2,221,414 | A | 11/1940 | Schmidt | |
| 2,895,735 | A | 7/1959 | Bartlett | |
| 3,192,880 | A | 7/1965 | Bergstrand | |
| 3,457,876 | A | 7/1969 | Holden | |
| 3,680,487 | A | 8/1972 | Cirami | |
| 3,780,665 | A | 12/1973 | Lohr et al. | |
| 3,791,305 | A | 2/1974 | Matelan | |
| 3,855,936 | A | 12/1974 | Schwarzkopf | |
| 4,054,290 | A * | 10/1977 | Villa | 463/51 |
| 4,170,943 | A | 10/1979 | Achrekar | |
| 4,520,732 | A | 6/1985 | Schwarzkopf | |
| D285,330 | S | 8/1986 | Okamoto | |
| D286,313 | S * | 10/1986 | Kurzweil | D21/830 |
| 4,693,186 | A | 9/1987 | Lisa | |
| D317,642 | S | 6/1991 | Hashimoto | |
| 5,136,227 | A | 8/1992 | Nakano et al. | |
| 5,193,462 | A | 3/1993 | Marcu | |
| 5,218,910 | A | 6/1993 | Mesmer et al. | |
| 5,272,984 | A | 12/1993 | Bolliger et al. | |
| D347,674 | S * | 6/1994 | Delaney et al. | D21/833 |
| 5,463,962 | A | 11/1995 | Gnezdilov | |
| 5,623,878 | A * | 4/1997 | Baxter et al. | 104/85 |

(Continued)

FOREIGN PATENT DOCUMENTS

DE 17 28 555 A1 8/1976

(Continued)

*Primary Examiner*—S. Joseph Morano
*Assistant Examiner*—Robert J McCarry, Jr.
(74) *Attorney, Agent, or Firm*—Gordon & Jacobson, PC

(57) ABSTRACT

A multi-track multi-vehicle coaster simulates a popular theme of a competition, struggle or conflict taken from history or fiction. The vehicles interact with each other and with the ride scenery in many different ways and vehicle velocity is altered at different points in the ride using multiple motors and brakes. An interactive queue is provided and allows people in the queue to interact with people on the ride. Energy recycling and computer ride control are also disclosed.

12 Claims, 18 Drawing Sheets

U.S. PATENT DOCUMENTS 5,669,821 A 9/1997 Prather et al.
5,716,281 A 2/1998 Dote
5,732,962 A 3/1998 Mageren et al.
5,791,254 A 8/1998 Mares et al.
5,906,542 A * 5/1999 Neumann ..... 463/52
5,934,176 A 8/1999 Mentink et al.
5,947,030 A 9/1999 Spieldiener et al.
5,979,827 A 11/1999 Corcoran
6,007,338 A * 12/1999 DiNunzio et al. ..... 434/55
6,060,847 A 5/2000 Hettema et al.
6,170,402 B1 * 1/2001 Rude et al. ..... 104/53
6,220,965 B1 * 4/2001 Hanna et al. ..... 463/52
7,126,583 B1 * 10/2006 Breed ..... 345/158
2004/0110565 A1 * 6/2004 Levesque ..... 463/42

FOREIGN PATENT DOCUMENTS

WO WO 91/13662 9/1991

* cited by examiner

MULTI-TRACK MULTI-VEHICLE INTERACTIVE ROLLER COASTER

This application claims the benefit of U.S. Provisional application No. 60/729,619 filed on Oct. 24, 2005.

BACKGROUND OF THE INVENTION

1. Field of the Invention

The present invention relates to amusement ride systems, and in particular, roller coasters. More specifically, the invention relates to a roller coaster ride having at least two distinct tracks with at least one vehicle traveling on each track and the vehicles interact with each other. As used herein the terms "roller coaster", "roller coaster ride", "coaster", and "coaster ride" shall have their usual meaning in the art; i.e., an amusement ride in which a vehicle intended to be ridden by one or more people is powered to a height and then travels by gravity on a track without power through a typically steep up and down and tortuous path around a circuit. The terms shall be understood to include rides where the vehicle may be powered by chain lifts or induction motors, hydraulic or pneumatic launches, tire drives, or other equivalent means more than once during the circuit to more than one height.

2. State of the Art

Roller coasters have enjoyed immense popularity in the United States and elsewhere for over one hundred years. These rides often consist of a passenger carrying vehicle, or collection of vehicles joined together, which traverse along a track system. Historically, the track system typically comprised a pair of parallel rails which exhibit steep upward and downward gradients in elevation, and sharp left and right banking turns. Aside from supplying the passenger with a pleasing panoramic view from high elevations, the main objective of the roller coaster ride was to thrill the passenger by traversing the track at the fastest possible speed while maintaining an acceptable degree of safety. The thrill experienced by the passenger thus arose through the sensations of rapid acceleration, brought about through rapid changes in vertical and horizontal direction of movement.

Innovations in roller coaster design have sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride. As a result, other innovations sought to enhance and intensify passenger thrill by incorporating increasingly complex geometries into the track system itself. Some common track geometries which have thus evolved are the loop, the cork screw, the banked helix, and the zero-G roll.

In parallel with the aforedescribed track system geometries, there also exist innovations in passenger vehicle configurations for enhancing and intensifying passenger thrill. These innovations typically depart from the conventional roller coaster in that the passenger vehicle no longer assumes the standard railway car configuration. For example, Achrekar (U.S. Pat. No. 4,170,943) discloses a suspended passenger vehicle configuration whereby individual passenger units are rotated and translated in a multiplanar manner as the carriage assembly proceeds along a Möbius strip, or one-half section of helical track. A more recent departure from the conventional passenger vehicle configuration is disclosed in Bolliger et al. (U.S. Pat. No. 5,272,984). The invention disclosed in Bolliger enables passengers to be suspended from a bogie moving along a horizontal track system, so that a seated passenger's head is in closer proximity to the bogie—and hence the track rails—than are the passenger's body and limbs. This configuration results in a passenger vehicle being designed so that each passenger is suspended with his legs in mid-air without a wall or a floor around him.

"Racing" rolling coasters typically have two side by side endless track loops, with the tracks parallel to each other. In this way, a roller coaster train on the first track can "race" with a roller coaster train on the second track. This well known "racing" feature provides added thrills and excitement for the riders. Generally, the roller coaster trains and tracks in racing coasters are made to be nearly as equivalent as possible, to provide for more competitive "racing". If one coaster train or track is consistently faster than the other, the racing coasters will increasingly be spaced farther and farther apart, as they progress over the track, and the sensation of racing will be lost. "Dueling" coasters are similar to racing coasters but the trains move in generally opposite directions. At one or more points in the track layout, the trains approach each other head on. Dueling coasters also require that the two trains be somewhat synchronized.

In the operation of racing coasters, each coaster is towed on its track or launched to side by side high points. The coasters are then released simultaneously. As the coasters are propelled purely by gravity, the coasters will be evenly matched only if the coaster speed related variables (such as coaster payload, coaster wheel bearing efficiency, coaster wheel concentricity, wind resistance, coaster wheel to track resistance, etc.) are comparable. If the combinations of these variables are comparable, then the racing coasters will be evenly matched, and will travel at the same speed over their tracks. However, these combinations of variables will more often than not result in one coaster train being significantly faster than the other, thereby undesirably reducing the advantages of racing coasters. Consequently, some of the excitement and thrills intended in the design of the racing roller coasters is often lost due to these types of variables. Trim brakes can be used to slow down the faster train, but nothing can be done to speed up the slower train.

U.S. Pat. No. 6,170,402 to Rude et al. describes a dueling or racing roller coaster ride that has tracks which approach or cross over each other at near miss locations. A controller system controls the timing of launch of a roller coaster vehicle on each track to better achieve consistent simultaneous arrival of the roller coaster vehicles at the near miss locations, to provide increased thrills and excitement to the riders. The control system determines the loaded vehicle weight via current draw on the track side vehicle motors. The control system generates a vehicle performance parameter, based on past vehicle speed over the track, to compensate for roller resistance and aerodynamic factors. The vehicle weight information and performance parameters are used to determine which vehicle to launch first, and the amount of delay between launching the vehicle on the first track and launching the vehicle on the second track, to better achieve simultaneous arrival at one or more locations.

While the Rude et al. patent discloses an interesting way to synchronize two trains on two tracks where one train is faster than the other, its goals are somewhat limited. In other words, the trains are controlled in only one of two ways, i.e. either by delaying their launch time or altering their launch speed.

SUMMARY OF THE INVENTION

It is therefore an object of the invention to provide a roller coaster ride having multiple tracks with at least one vehicle on each track.

It is another object of the invention to provide a roller coaster ride in which the individual speed of each of multiple vehicles is controlled.

It is a further object of the invention to provide a roller coaster ride in which the individual speed of each of multiple vehicles is controlled in more than one way.

It is also an object of the invention to provide a roller coaster ride where individual vehicle appearance and multiple vehicle interaction are patterned after a popular theme of struggle.

It is an additional object of the invention to provide a roller coaster ride in which track layouts are arranged to simulate maneuvers of a vehicle in flight.

It is still another object of the invention to provide a roller coaster ride in which individual vehicles pass each other in close proximity in opposite directions.

It is yet another object of the invention to provide a roller coaster ride in which individual vehicles are equipped with lasers and laser sensors so that vehicles can "shoot" at each other and score a "hit" if the shot is correctly aimed;

It is also an object of the invention to provide a roller coaster ride in which groups of vehicles form teams.

It is an additional object of the invention to provide a roller coaster ride in which vehicles include heads up displays.

It is still another object of the invention to provide a roller coaster ride in which optical illusions are employed such as, holographic projections, camouflaged tracks, and special effects generators on board vehicles.

It is yet another object of the invention to provide a roller coaster ride with multiple loading and unloading stations.

It is also an object of the invention to provide a roller coaster ride in which vehicles are re-routed to different loading and unloading stations through the use of switch tracks.

It is another object of the invention to provide ways in which would-be riders waiting in queue to board the ride can interact with riders.

In accord with these and other objects, which will be discussed in detail below, the roller coaster ride according to the invention includes more than two tracks with at least one vehicle on each track wherein the tracks are arranged such that the vehicles enter an area and visually engage each other. In order to coordinate the placement of each vehicle at the point(s) of engagement, various controls are applied including altering launch speed, altering launch time, mid course braking, and mid-course acceleration. In one embodiment, there is one vehicle per track and vehicles are launched approximately simultaneously. Depending on the theme and size of the vehicle, the vehicle may be a single passenger vehicle or a multi-passenger vehicle.

According to one aspect of the invention, the vehicles of the roller coaster ride simulate vehicles used in popular fictional or non-fictional conflicts, such as Star Wars space vehicles, vehicles (broomsticks) from Harry Potter, WWI dogfighters, King Kong dogfighters, etc. According to another aspect of the invention, the tracks are laid out so that the vehicle movement is choreographed to mimic scenes from the competition or conflict being simulated.

In other embodiments of the invention, vehicles are equipped to interact with each other using, e.g. laser guns and sensors and heads up displays. Some embodiments may require groups of vehicles to act as teams competing against one or more other teams of vehicles.

Still another aspect of the invention combines the ride with multimedia special effects including holographic projections in scenery surrounding the vehicles or on the vehicles themselves, and/or camouflaging the coaster track so that it is indistinguishable from the surrounding environment, even when the track runs through several different environments.

The vehicles are preferably controlled with linear induction motors (LIMs) and linear eddy-current brakes (LECBs) which are activated by a computer control which receives input from sensors along the tracks. The vehicles are also preferably supplied with over-the-shoulder restraints (OTSRs) to protect the passengers during banking and rolling maneuvers. The vehicles are preferably designed to have an upper body and a lower frame. The lower frame includes the wheels, the brake fins, and all of the other unsightly equipment needed to make the vehicle function. The upper body is designed to conceal the lower frame and in one embodiment is provided with fold down doors on both sides (or a single door in the case of a single occupant vehicle). An exemplary embodiment of the invention is based on the first Star Wars film in which "TIE" fighters and "X-wing" fighters battle each other and while the "X-wing" fighters attempt to destroy the "Death Star". In this embodiment, a portion of the ride involves X-wing fighters engaging with the Death Star (scenery). According to one aspect of the invention illustrated in this embodiment, the queue for the ride is channeled through the back of the scenery of the Death Star and people in the queue can look through windows at the riders battling the Death Star. In addition, people in the queue are provided with opportunities to operate Death Star armaments and fire at the X-wing fighters. In this illustrative embodiment, at least one unmanned fighter appears at one portion of the ride and interacts with another manned or unmanned fighter. According to another aspect of the invention, the LIM motors are powered by s combination of batteries and non-battery power and the batteries are at least partially recharged by the LECB brakes.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
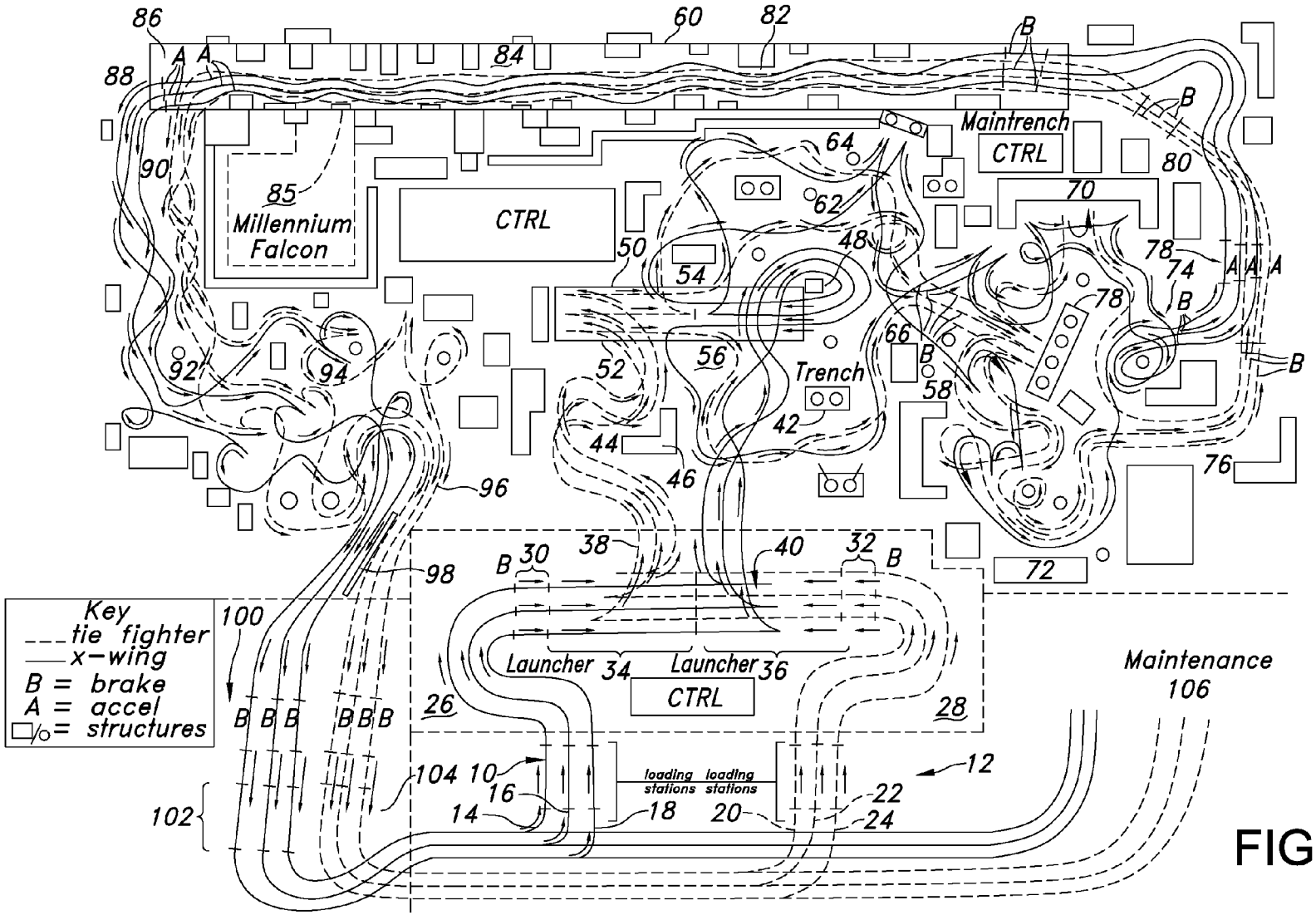
FIG. 1 is a plan view of a track and scenery layout of a roller coaster ride illustrating some of the aspects of the invention.
Figure 1A:
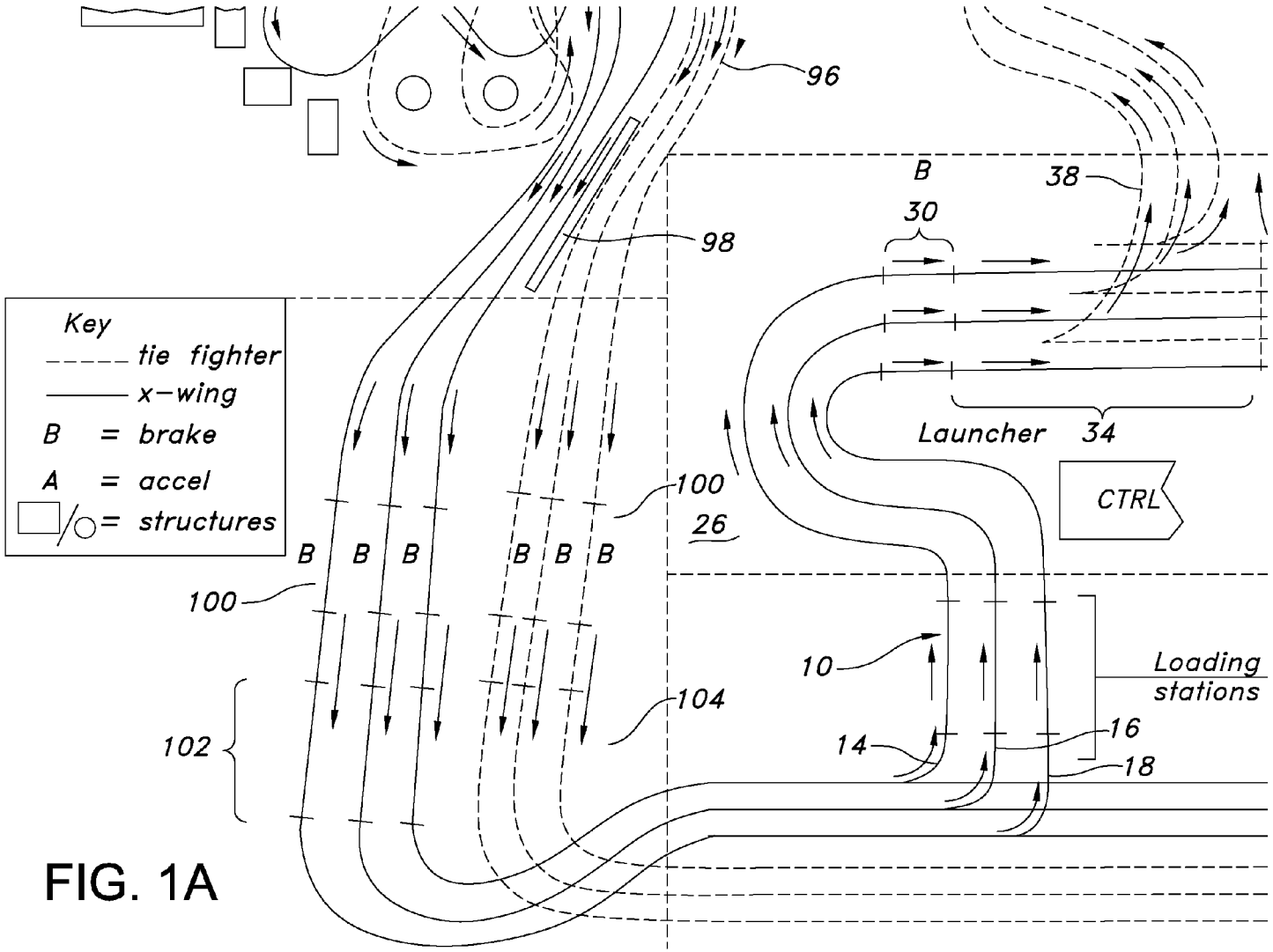
FIGS. 1A-1D are enlarged portions of FIG. 1.
Figure 1B:
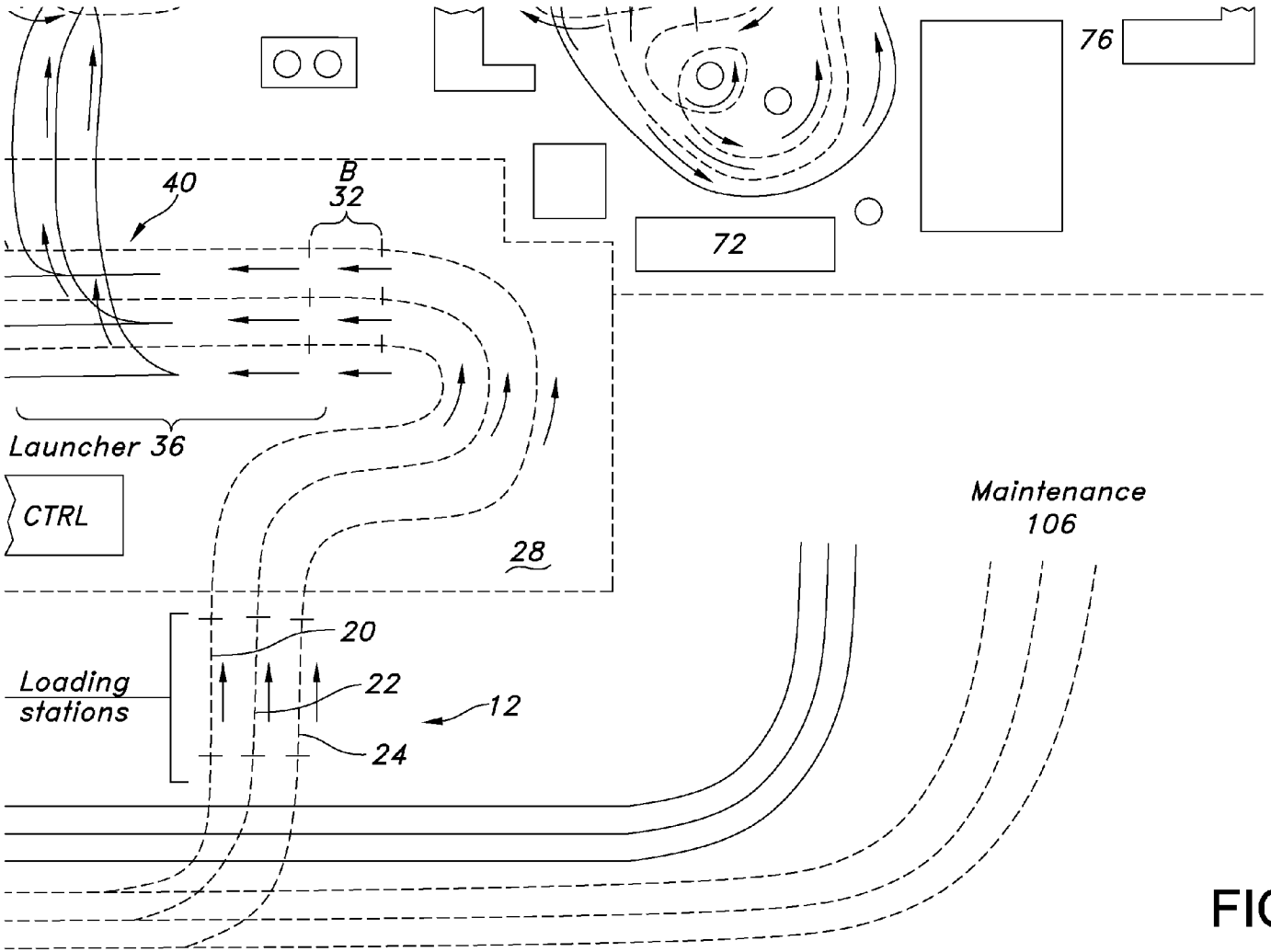
Figure 1C:
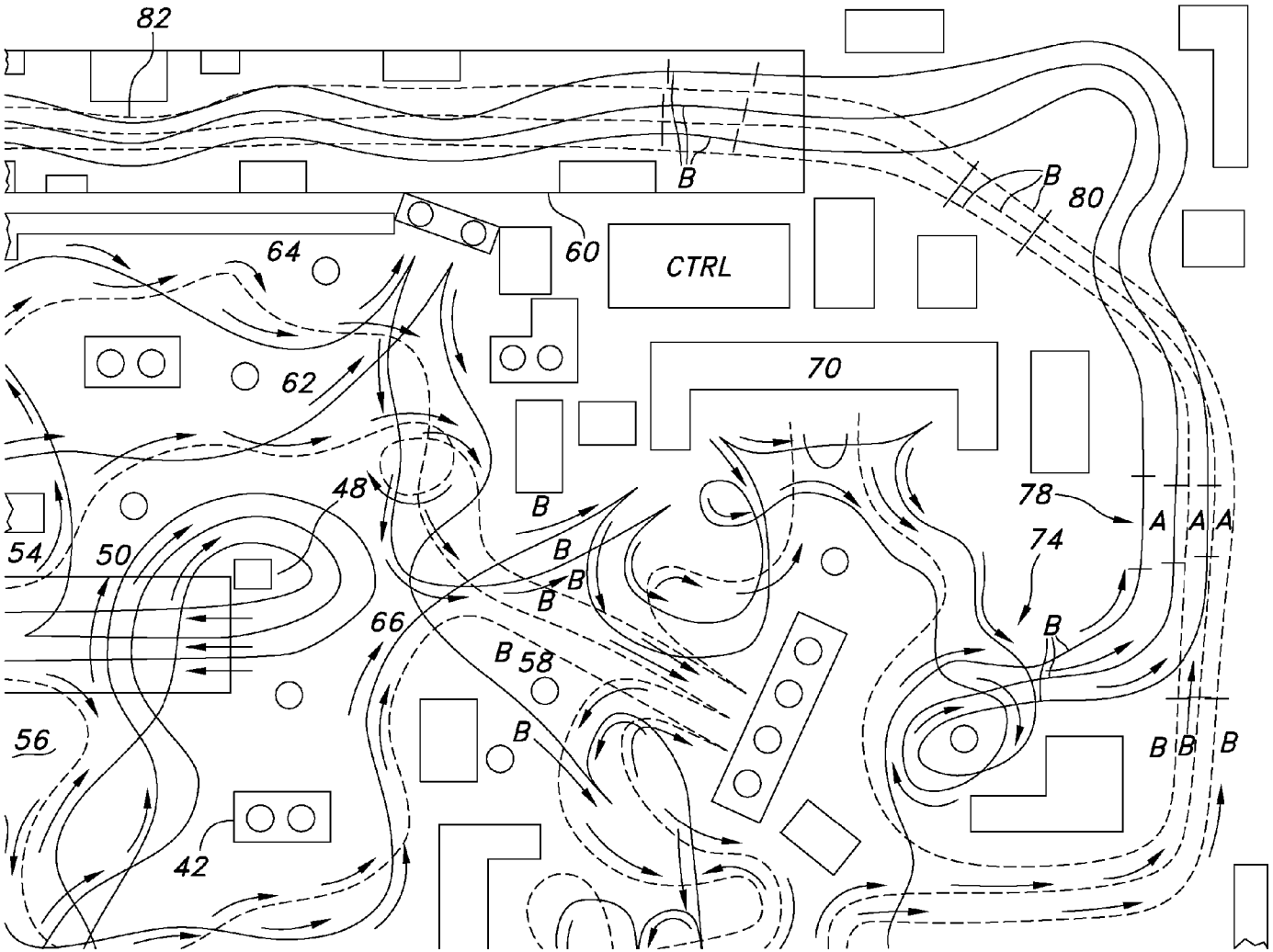
Figure 1D:
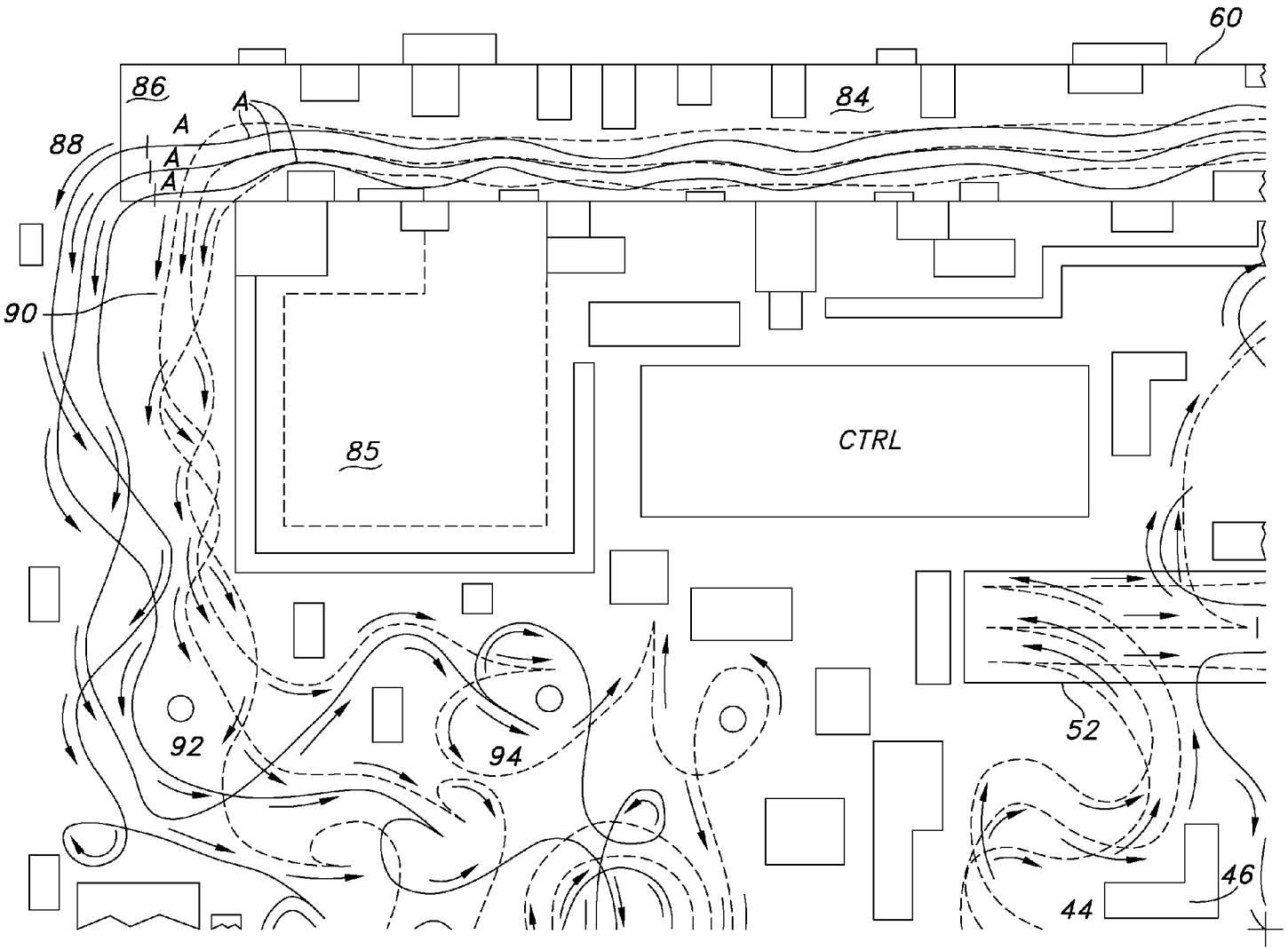

Turning now to FIGS. 1 and 1A through 1D, in this example of a roller coaster ride according to the example there are two loading stations 10 and 12. Three tracks 14, 16, 18 pass through loading station 10 and three tracks 20, 22, 24 pass through loading station 12. Preferably, the stations are separated from each other so that the riders boarding at station 10 cannot see the riders at station 12 and vice versa. In this example, the tracks 14, 16, 18 at station 10 each carry a vehicle which simulates a STAR WARS X-wing fighter. The vehicle is described in more detail below with reference to FIGS. 5-9. The tracks 20, 22, 24 at station 12 each carry a vehicle which replicates a STAR WARS TIE fighter. The scenery at the loading stations also simulates the STAR WARS theme. At station 10, the scenery simulates the "Rebel Base hangar" and the scenery at station 12 simulates the "Death Star hangar".

When the ride begins, the vehicles are "tire propelled" slowly through darkened tunnels 26, 28 where themed animatronics build suspense. The vehicles are braked at points 30, 32 before LIM launchers 34, 36. The vehicles are held here until vehicles in front of them reach MCBR (mid coaster brake run) as described hereinafter. At launch, brakes release and the LIMs are activated in a sequence based on the weight of the vehicles as described in more detail below with reference to FIGS. 2 and 5-9. The TIE vehicles and the X-wing vehicles are launched at each other by the launchers 34, 36. At launch, the vehicles on tracks 14, 16, 18 preferably are and preferably continue to travel parallel to each other and the vehicles on tracks 20, 22, 24 preferably are and preferably continue to travel parallel to each other. In the illustrated embodiment, the launch room (e.g., the area surrounding the launchers 34, 36) is separate from the rest of the ride and has sparse scenery simulating outer space with distant stars.

After passing each other at high speeds during launch, the vehicles enter half loops followed by half cork screws at 38 and 40 moving out of the launch room and into the "main arena" via short tunnels. The main arena is constructed to simulate the surface of the STAR WARS Death Star as is apparent from FIG. 1. The ceiling of the main arena is constructed to look like outer space, i.e. black with distant twinkling stars. The main arena includes moving gun turrets with lasers and smoke so that the laser beams can be seen.

The X-wing vehicles enter the arena, split out of parallel formation and dodge laser fire from turrets in the area 42. The TIE fighters remain in parallel formation and navigate tight passageways between towers and turrets. One of the TIE fighters breaks formation at a close corner 46. As described in more detail below, the TIE fighters and X-wing audio systems reproduce radio "chatter" from the death star.

At 48 the X-wing vehicles swoop in a low curve into a trench 50. At 52 the TIE vehicles swoop down in a half twist and dive into the trench 50. The vehicles approach other at high speed in the trench and exit the trench with half cork screws with partial in-line twist at 54 and 56. The track length and layout has now positioned the TIE vehicles ahead of and pursued by the X-wing vehicles and the vehicles have broken formation. As shown in the figures, the six vehicles have split into three pairs, each pair being one X-wing vehicle and one TIE vehicle. One pair which exits the trench at 56 proceeds back toward the launch room dipping between firing turrets and towers back through the area 42 and toward a loop system area 58. Another pair which exits the trench at 54 travels away from the launch room toward the main trench 60 dueling until the X-wing breaks off at 62 into a half-loop twist while the TIE fighter it was pursuing moves around to pursue the X-wing. The third pair which also exits the trench at 54 performs similar maneuvers at 64.

All of the vehicles converge around area 66 where brakes are selectively applied by the control system (described in more detail below with reference to FIG. 2) to ensure that all of the vehicles are time-space synchronized before entering the loop system 58. Three TIE fighters nearly collide with wall 68 but loop up and away just in time. The three X-wings split off and perform a similar maneuver.

After avoiding collision with the wall 68, the vehicles split into two groups of three. One group of two X-wings chase a TIE fighter which heads toward wall 70 performing loops and evasive maneuvers. The other group of two TIE fighters chase an X-wing which heads towards wall 72. The X-wing performs a cobra roll, dodges obstacles and firing turrets. The TIE fighters maneuver in sharp curves and helices dodging obstacles and keeping in formation as much as possible.

Eventually the lone X-wing rejoins formation with the other X-wings at 74 and the TIE fighters reunite in parallel formation at 76. Brakes are selectively applied to realign the vehicles. The TIE fighters take a longer route to insure that they will be a set distance behind the X-wing group when they enter the second launch system 78. The second launch system sends the vehicles swiftly forward and up a hill to the MCBR 80 where all of the vehicles can be stopped in the case of an emergency. The MCBR positions the cars at the peak of a hill so that if they need to be stopped, when they are released gravity will propel them through the remainder of the ride or through to the next launch system.

Following the MCBR, the X-wings plunge into the main trench 60 and begin weaving between turrets and obstacles based on the original STAR WARS film. The TIE fighters follow behind the X-wings but stay above the obstacles. The TIE fighters move up and down to avoid obstacles. Moving down, the riders experience negative g-forces. As the X-wings are chased by the TIE fighters, audio in the vehicles simulates a mood of desperation in the X-wing group. Small braking of the X-wing vehicles at point 82 in the trench allows the TIE fighters to catch up and the tracks are arranged so that the TIE fighters bear down on the X-wings. TIE fighter weapon fire increases as the vehicles approach point 84 in the trench. At this point turret fire can be increased and/or unmanned TIE fighters can be introduced.

Figure 13:
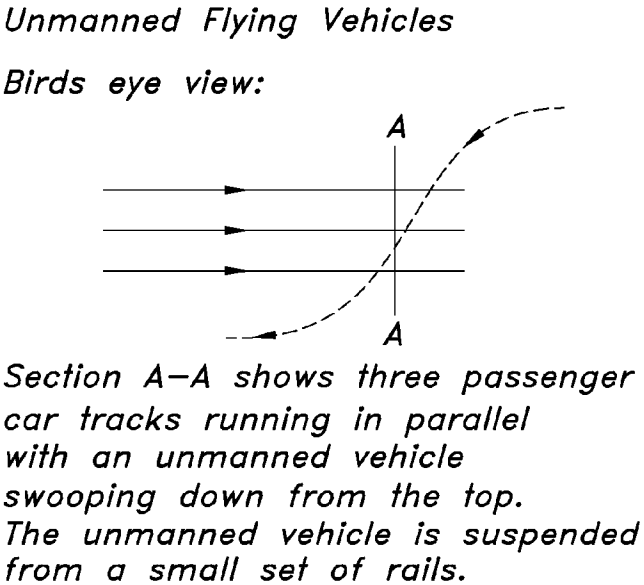
FIG. 13 is a schematic plan view illustrating the interaction between manned and unmanned moving vehicles.

After the X-wings pass point 84, an unmanned vehicle 86 (the "Millennium Falcon") swoops down on an invisible (camouflaged) track across the path of the TIE fighters firing laser cannons at the TIE fighters. This is illustrated schematically in FIG. 13 where the path of the TIE fighters is shown in solid line and the path of the Millennium Falcon is shown in a broken line. The track is arranged so that the TIE fighters shake and twist as they are hit with laser fire. Once all of the vehicles have passed, the Millennium Falcon returns to its original position. Before exiting the trench at 86, the X-wings deliver proton torpedoes into the "thermal exhaust port" of the Death Star. This is simulated with holographic imaging or by having objects ride on invisible wires into a hole in the floor. According to one aspect of the invention, aiming of the torpedo is simulated by a heads up display on the vehicles.

The X-wings exit the trench and join in formation at 88 and the TIE fighters exit into crossing maneuvers at 90. All of the vehicles feel an explosion effect, when appropriate, through subwoofers installed in the vehicles. The vehicles continue side by side until they split into three groups at 92. Each group performs similar maneuvers including half loops and half cork screws at 92 and dodge obstacles at 94 before regrouping at 96. After regrouping they preferably disappear from each other's sight by passing on opposite sides of a wall 98. Brakes are applied at 100. Kicker wheels engage the vehicles to bring them forward to the unloading bays 102 and 104 which are preferably separated from each other by a wall. After unloading, kicker wheels propel the vehicles back to the launch stations 10, 12 or through a switch off to a maintenance area 106.

The example described above illustrates the following features of the invention: at least three tracks, each track having at least one vehicle, vehicles being braked and accelerated at mid-course locations, interaction among vehicles simulating a popular conflict or struggle or competition, track design simulating the trajectory of a vehicle in flight, vehicles approaching each other in close proximity in opposite directions, laser shots and photo sensors detecting hits, groups of vehicles forming teams, heads up displays on vehicles, special effects on board vehicles, and multiple loading and unloading stations.

Figure 2:
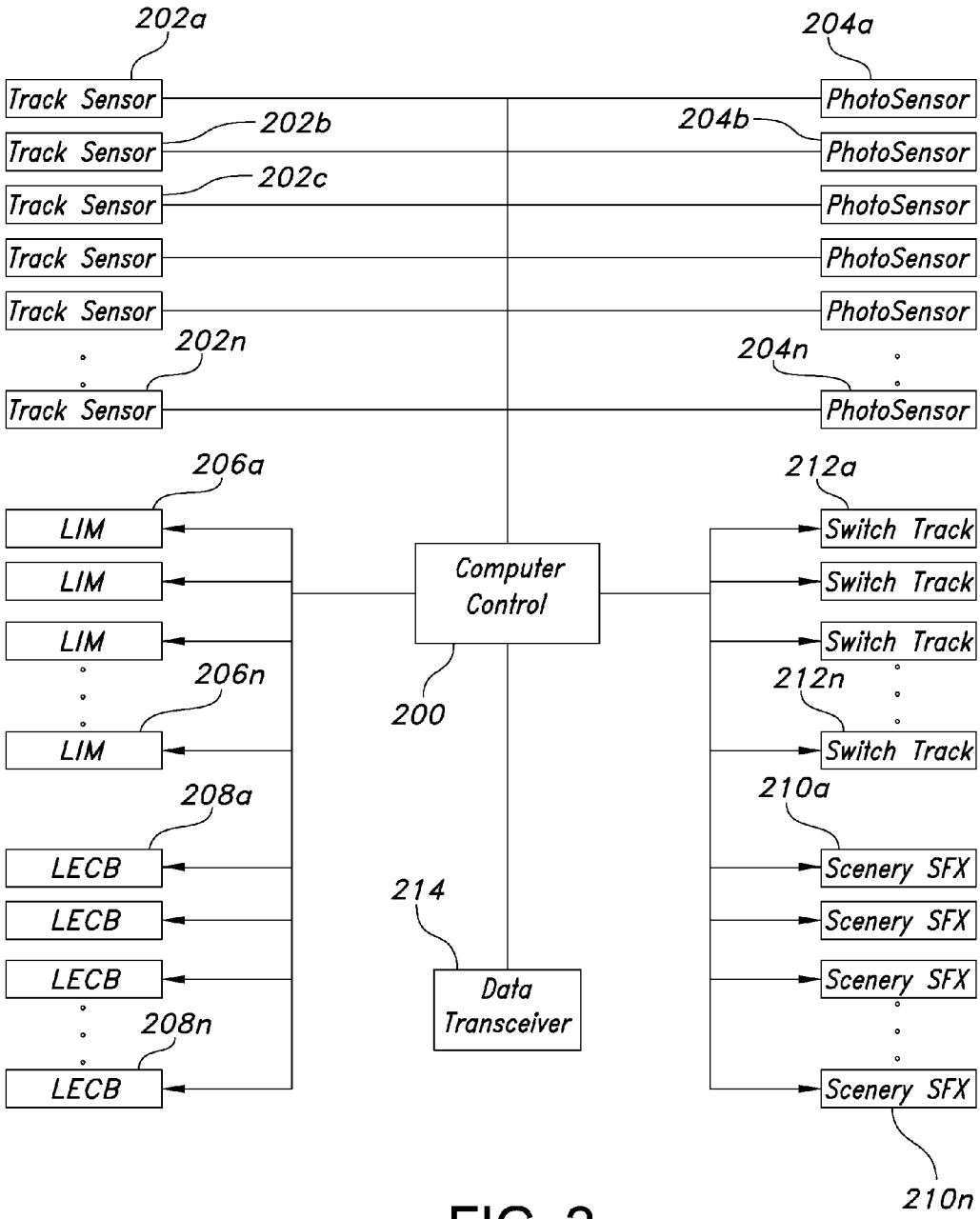
FIG. 2 is a simplified schematic block diagram of a control system for operating the coaster ride of FIG. 1

Turning now to FIG. 2, in order to choreograph movement of the vehicles through the main arena and coordinate special effects, it is necessary to use a computer control 200. The computer control 200 takes input from a plurality of track sensors 202*a*-202*n* and a plurality of photo sensors 204*a*-204*n* located throughout the main arena. It provides output to a plurality of launch motors 206*a*-206*n*, a plurality of brakes 208*a*-208*n*, and a plurality of special effects devices 210*a*-210*n* which are located throughout the main arena. Optionally, it provides output to a plurality of switch tracks 212*a*-212*n*. Preferably, the computer control 200 communicates bi-directionally with each vehicle via a data transceiver system 214.

The track sensors 202*a*-202*n* provide information such as vehicle location (using RFID for example), vehicle speed (optical or inductive sensors for example), and vehicle weight (using strain gauges for example). The photo sensors 204*a*-204*n* provide information about "laser hits" throughout the arena. The computer controls the LIM launching motors at the proper time and with the proper velocity to keep the vehicles synchronized to the planned choreography. This control is based on a program which takes into account time and the weight of the vehicle as well as track sensor input. Similarly the computer controls the LECB brakes at the proper time and with the proper amount of damping based on the same parameters. The computer controls the scenery special effects based on a program as well as input from the track sensors and the photo sensors. The computer uses the data transceiver to trigger audiovisual effects on each vehicle and to receive information about each vehicle such as passenger weight and vehicle safety information.

Figure 3:
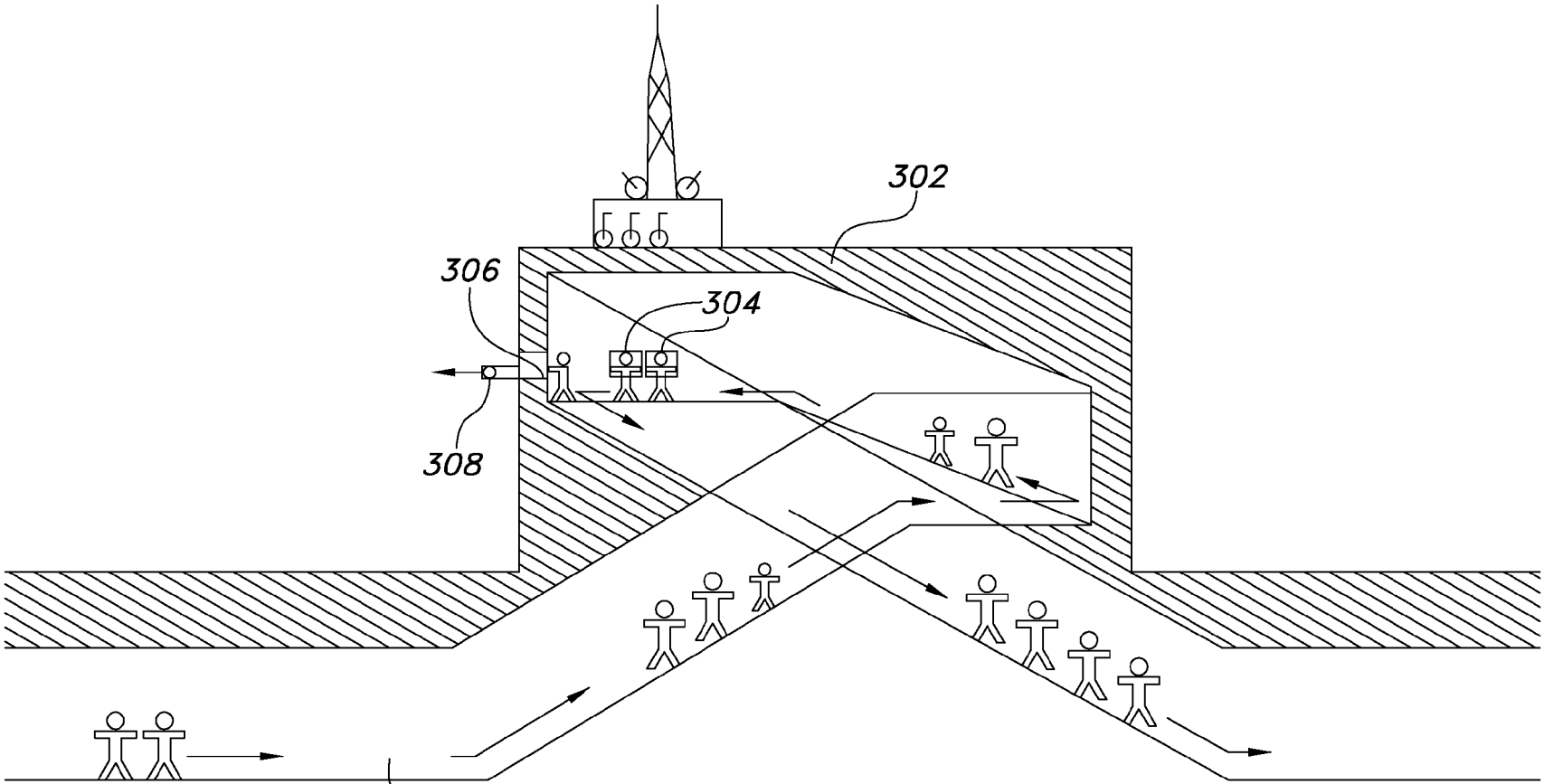
FIG. 3 is a sectional view illustrating the interior of scenery with an interactive rider queue.

FIG. 3 illustrates an interactive queue according to the invention in the example of FIG. 1. The riders enter the queue corridor 300 adjacent the main trench (60 in FIG. 1) and walk through the corridor which is beneath the main arena. The corridor is decorated to resemble the interior of the STAR WARS Death Star and includes animatronics, video displays and other special effects. Portions of the pathway are motorized to simulate movement in an explosion. These portions are provided with smoke generators, subwoofers and emergency alarm sounds to simulate an explosion on the surface of the Death Star. The corridor 300 weaves around under the main arena and at various locations ramps up to the interior of a turret 302. The turret 302 is provided with windows 304 where people in the queue can look out onto the main arena and see X-wings and TIE fighters flying above the surface of the Death Star. The turret 302 is also preferably provided with interactive controls 306 where laser cannons 308 can be operated by people in the queue to shoot at the vehicles flying over the Death Star. Separate queues may be provided for X-wing loading and TIE fighter loading or a single queue may split in two before reaching the loading stations.

Figure 4:
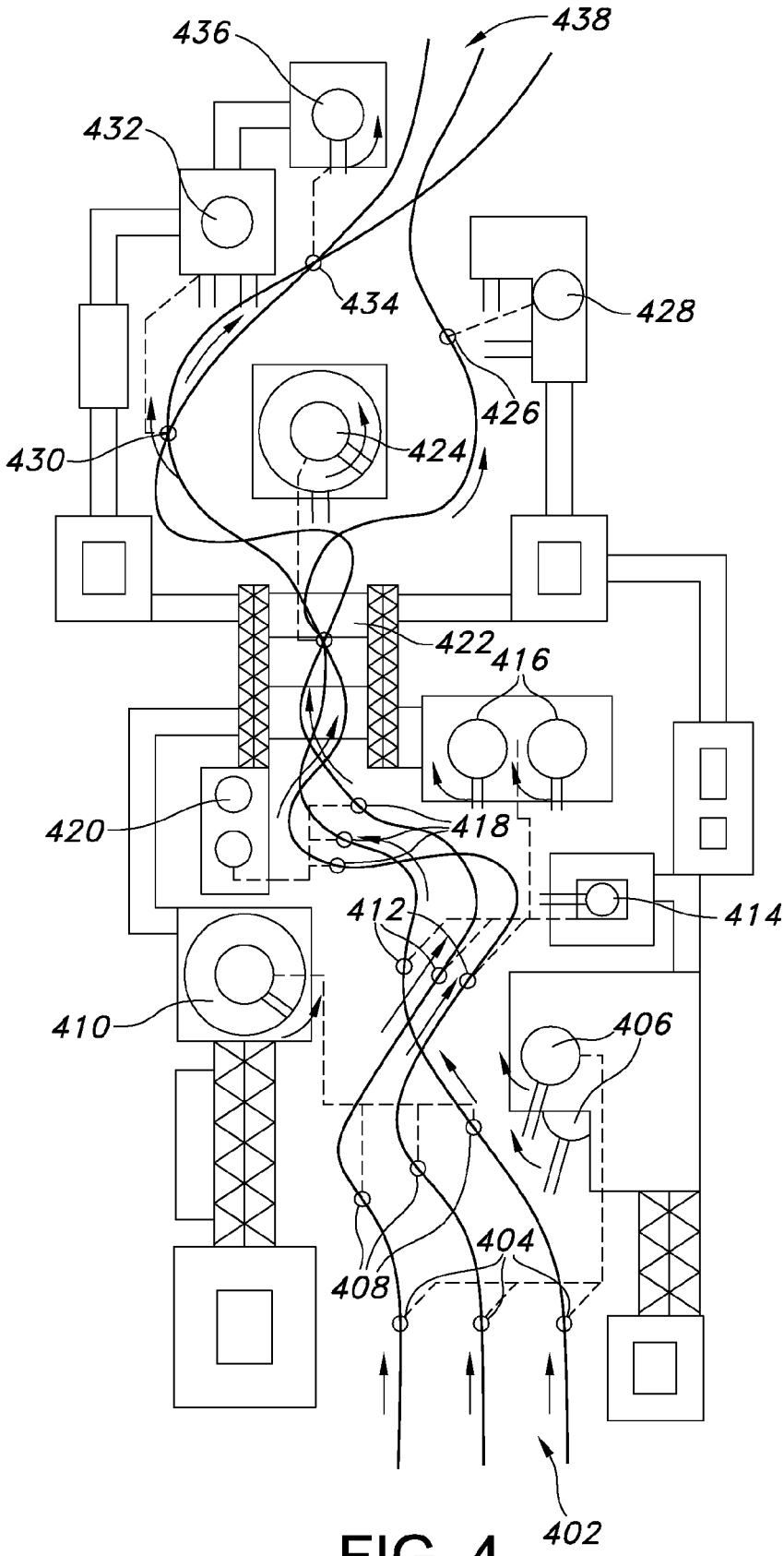
FIG. 4 is a plan view illustrating scenery interaction and interaction between riders and would-be riders on the queue.

FIG. 4 illustrates how track sensors are used to trigger special effects in the scenery. Vehicles enter a turret protected area at 402 and trigger a sensor at 404. The sensor sends a signal to the computer control which causes the turrets at 406 to fire lasers, dispense smoke, and rotate to follow the vehicles as they proceed along the tracks. Those skilled in the art will appreciate that this particular effect could be accomplished without the use of the computer control and the sensor 404 could be directly coupled to the turrets at 406.

At 408 another sensor is triggered and turrets at 410 fire and rotate to follow the vehicles. Sensor 412 activates stationary turrets 414 and 416 and sensor 418 activates a rapid fire floor gun 420. A sensor 422 is triggered as the vehicles exit a tunnel and activates a pair of turrets 424 which fire in opposite directions and follow the vehicles which split off on opposite sides of the turrets. Sensor 426 activates turret 428 and sensor 430 activates turret 432. Sensor 434 activates turret 436 and the vehicles exit the protected area at 438.

Figure 5:
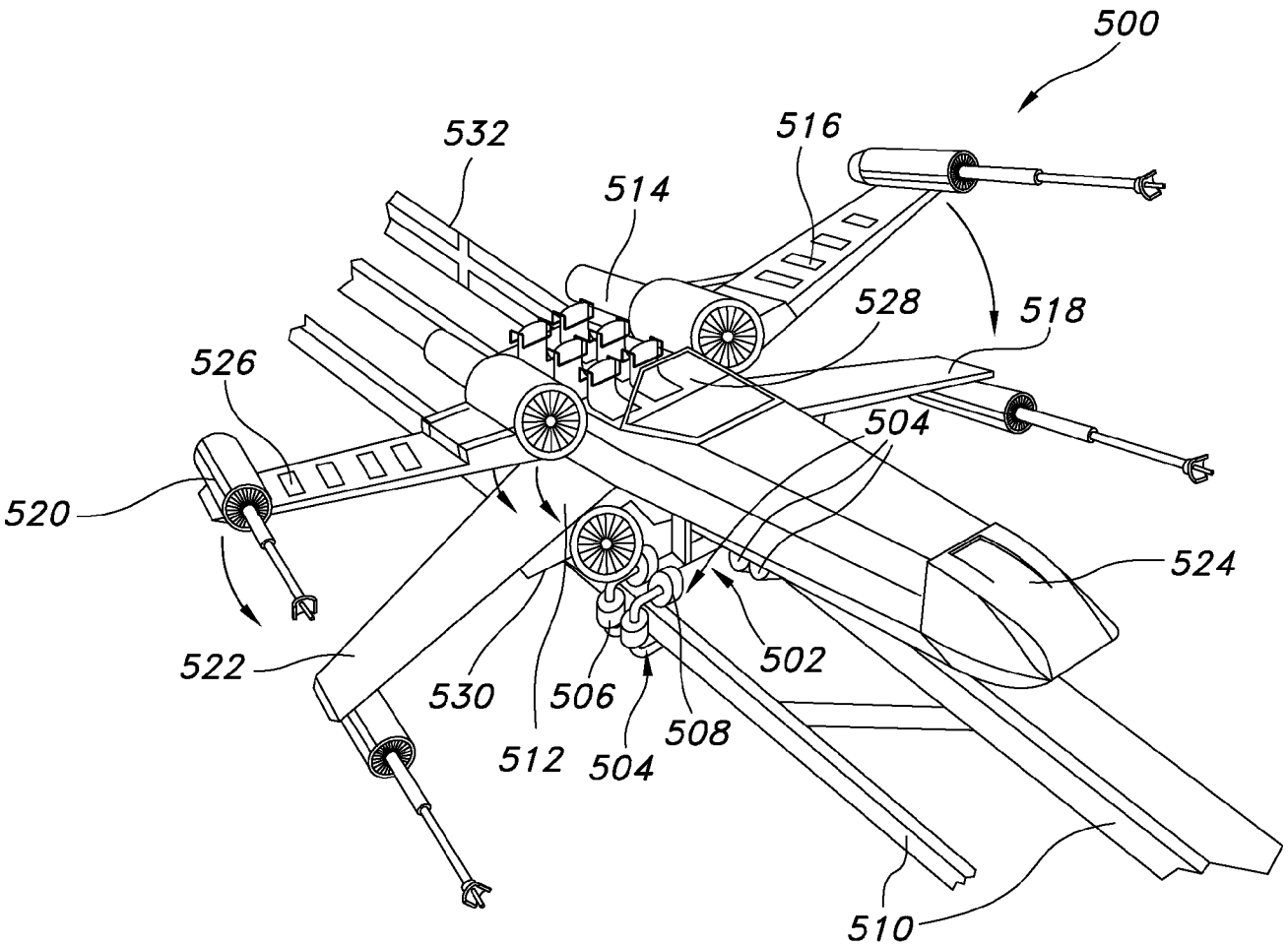
FIG. 5 is a schematic perspective view of an X-wing vehicle on a track.

FIGS. 5-9 illustrate an X-wing roller coaster vehicle according to the invention. Referring first to FIG. 5, the vehicle 500 has a carriage 502 with four wheel assemblies, one of which can be seen. The wheel assemblies preferably each include upstop wheels 504, side wheels 506, and tractor wheels 508. The wheels are used to engage the tracks 510 in manners well known in the art. A vehicle body 512 is mounted on the carriage 502. The body 512 generally includes a passenger compartment 514 (in the illustrated embodiment, the passenger compartment holds six passengers), four wings 516, 518, 520, 522, and an extended nose 524. Electronic, hydraulic and/or pneumatic systems are preferably housed in the nose 524. The top wings 516 and 520 are preferably provided with hinges (not shown) to permit them to rotate so as to act as ramps as shown by the arrows and to allow entry to the passenger compartment 514. Each of the movable wings preferably is provided with foot treads, e.g. 526. A heads up display (HUD) 528 is preferably provided between the passenger compartment 514 and the nose 524. Launch and brake fins, e.g. 530 are mounted on both sides of the carriage and are arranged to approximate LIM launchers and LECB brakes, e.g. 532.

Figure 6:
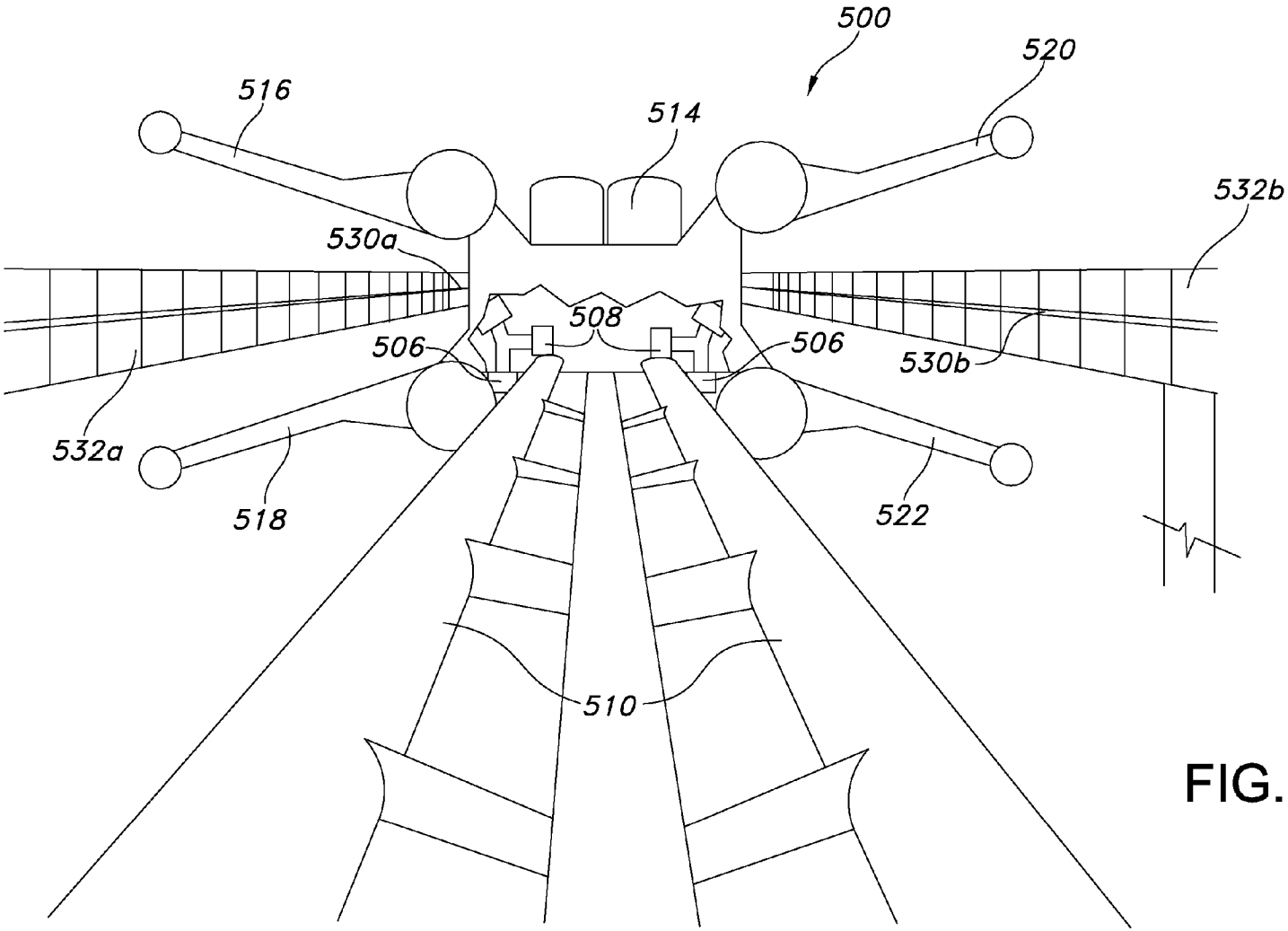
FIG. 6 is a partially cut away schematic rear view of the vehicle of FIG. 5.

FIG. 6 shows the rear of the vehicle 500 on the track 510 at a LIM launch station. Two fins 530*a* and 530*b* approximate two LIM devices 532*a*, 532*b* respectively, on either side of the vehicle The arrows in FIG. 6 illustrate the clearances between the wings and the wall, floor and LIM device.

Figure 7:
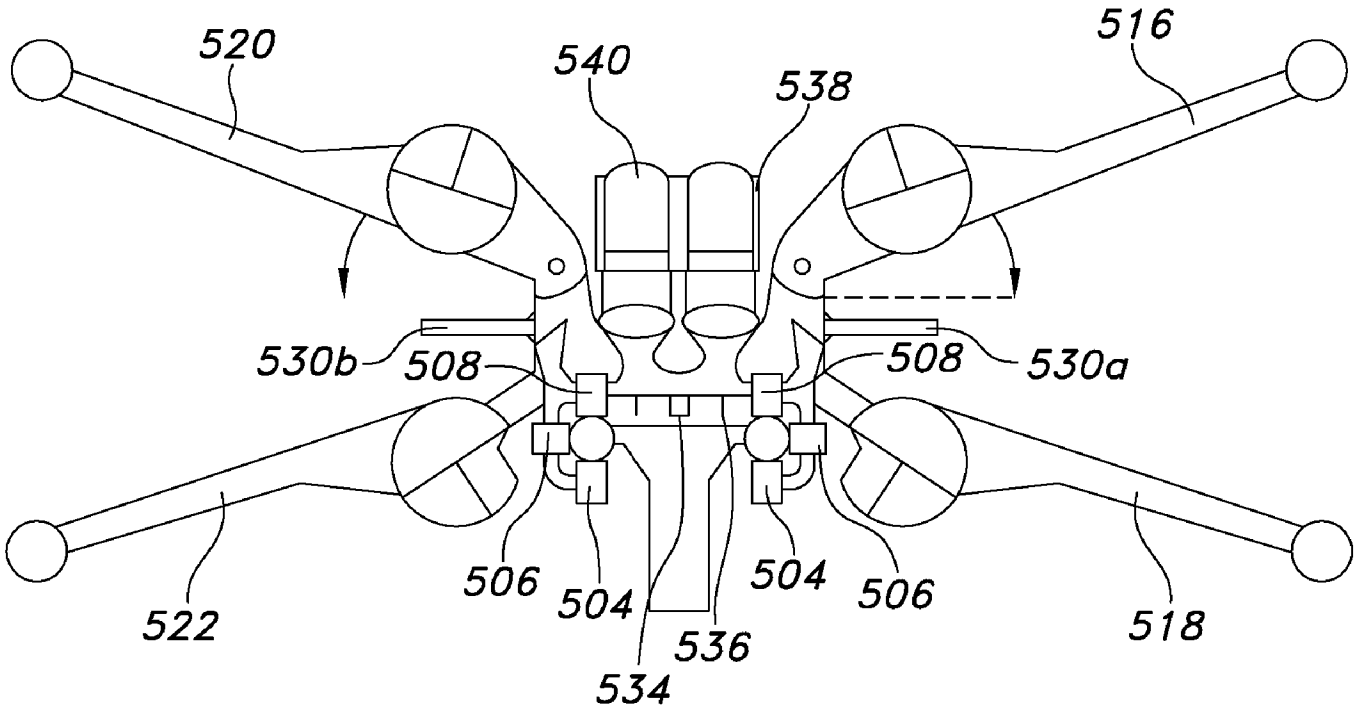
FIG. 7 is a partially cut away schematic front view of the vehicle of FIG. 5.

FIG. 7 shows that the vehicle has an anti-rollback ratchet 534, a power coupling roller 536 and over the shoulder restraints 538 which fold over seats 540. The ratchet 534 ensures that the vehicle does not roll back on hills equipped with anti-rollback grooves. The power coupling roller 536 engages a third rail between the unloading and loading station so that batteries on board the vehicle are charged. Dotted lines in FIG. 7 also show the stop point where the wings 516, 520 lower to board the vehicle.

Figure 8:
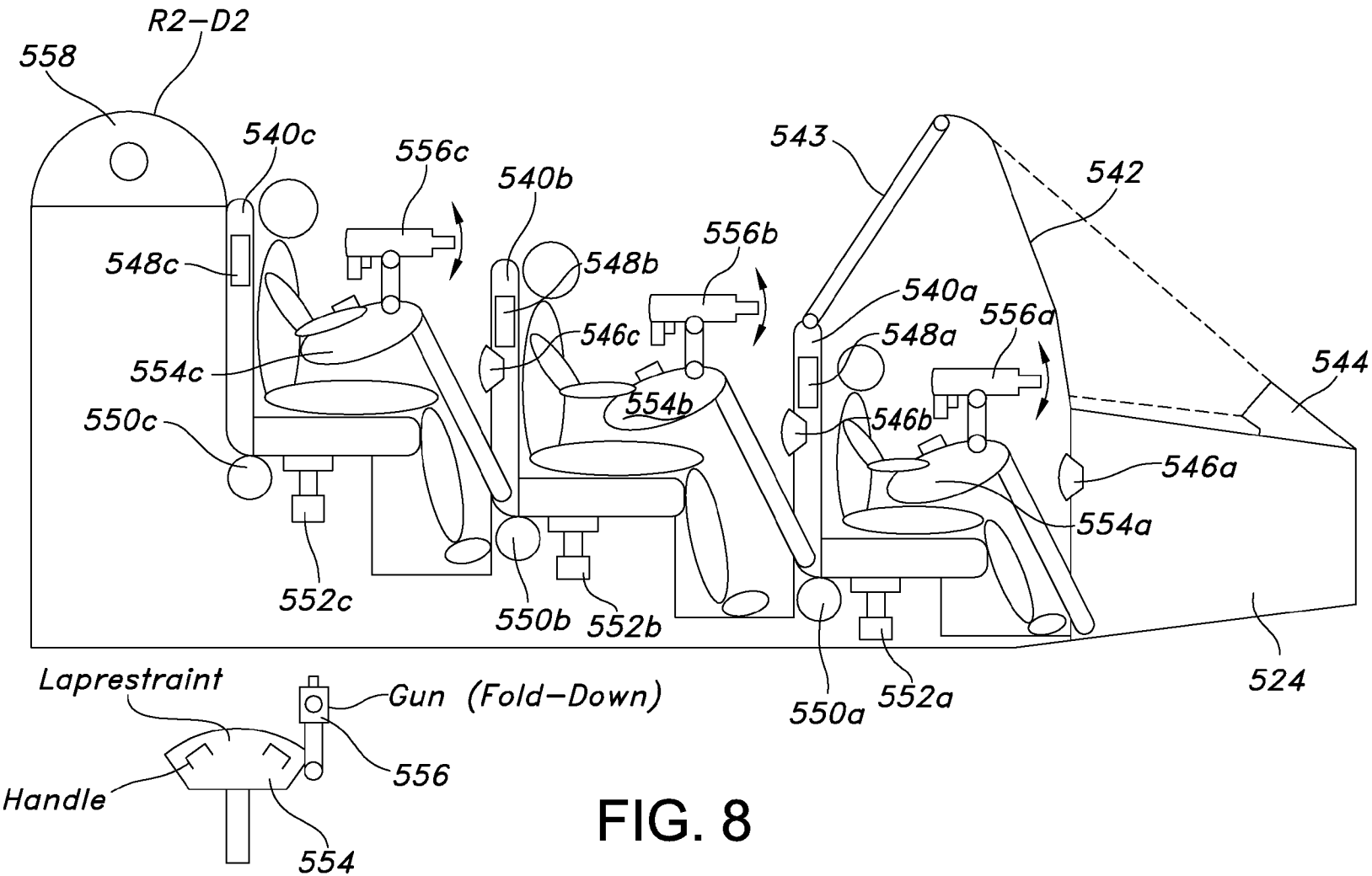
FIG. 8 is a broken schematic side elevation view of the vehicle of FIG. 5.

FIG. 8 shows more detail of the passenger compartment 514 of the vehicle 500. It will be appreciated that the seats 540*a*, 540*b*, 540*c* are preferably arranged in a slight stadium style so that riders can see over the heads of riders sitting in front of them. This is desirable to permit all of the riders to see the heads up display (HUD) 542. The HUD is made of a transparent material which is also capable of displaying images that are projected onto it by the HUD projector 544 in the nose 524 of the vehicle. (Alternatively, the HUD uses a transparent LCD technology.) The HUD is preferably narrower than the seating area so that the passengers can feel wind during rapid movement. As illustrated, the HUD is supported by a bar 543 which extends from the top of the front seat 540*a*. The HUD is controlled by an onboard computer but the central computer control (FIG. 2) also sends messages to the onboard computer regarding what images to display on the HUD.

There are three speakers associated with each seat. One speaker 546*a-c* faces the occupant of the seat. Another speaker 548*a-c* is located in the seat back. A sub-woofer 550*a-c* is located under the seat. As previously mentioned, the speakers can be used to generate sound effects such as radio chatter, and other sounds which may be taken, if desired, from the movie sound track.

In the discussion of FIG. 2 it was suggested that vehicle weight is ascertained with track sensors. Alternatively or in addition, weight can be ascertained with scales 552*a-c* mounted under the seats 540*a-c*. This also has the advantage of providing weight balancing information.

As illustrated in FIG. 8, each seat is provided with a lap restraint 554*a-c* upon which a passenger controlled laser pistol 556*a-c* is mounted. The pistol is mounted in a manner so that it can be tilted and swiveled so that the operator can aim it at other vehicles and at objects in the main arena. As mentioned above, photo detectors are placed on vehicles and items in the main arena such as gun turrets. When a rider fires a laser pistol at a photo detector, a hit is recorded and special effects are triggered. These effects may include sound, smoke, and an indication on the HUD. The pistols 556*a-c* are connected to the lap restraints 554*a-c* in such a manner that they fold out of the way during loading and unloading of the vehicle. A STAR WARS R2 droid 558 is optionally mounted on the vehicle behind the passenger compartment. It rotates and makes noises like the droid in the STAR WARS films.

Figure 9:
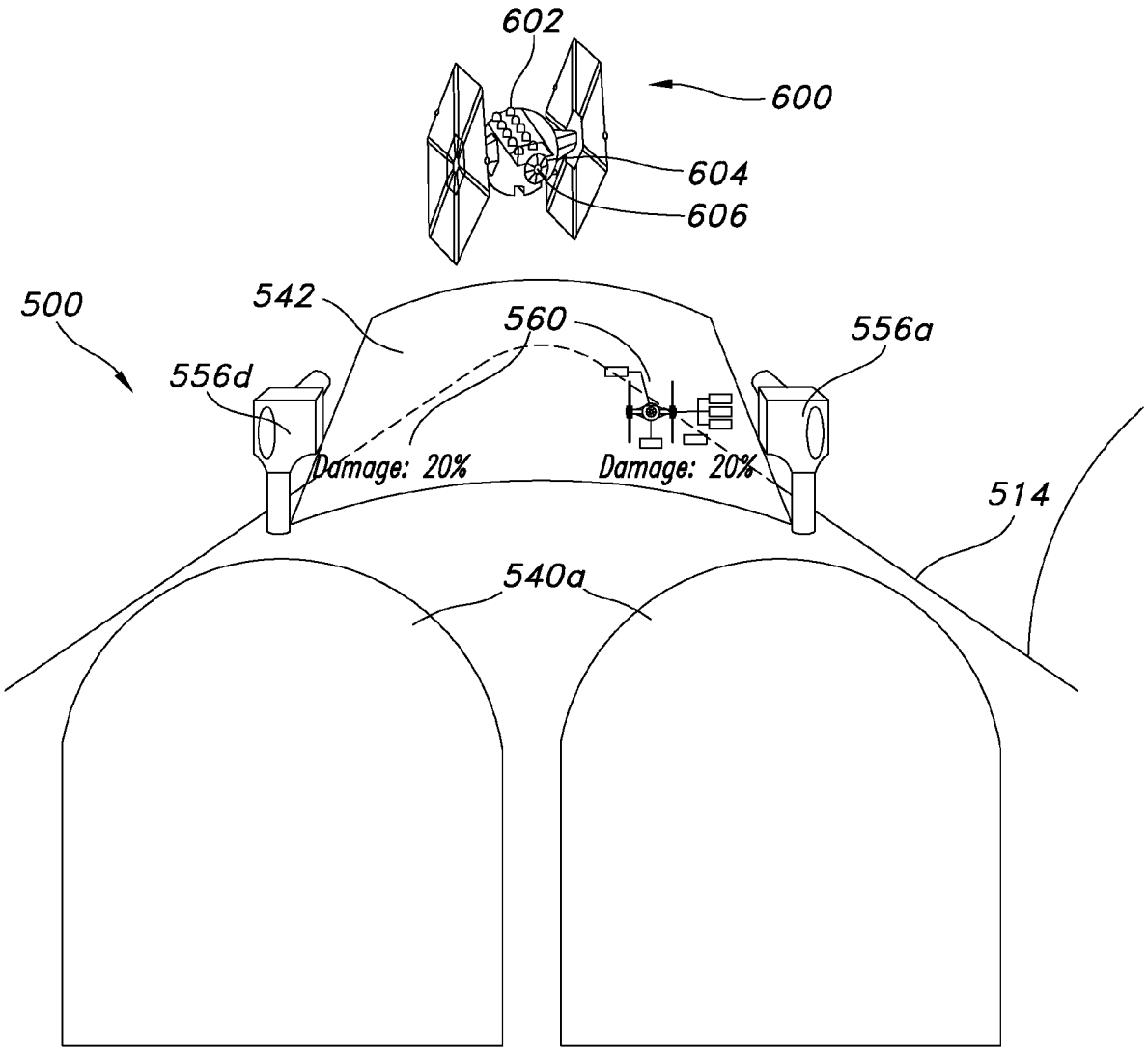
FIG. 9 is a broken schematic interior view looking forward in the vehicle of FIG. 5.

FIG. 9 shows a view from the passenger compartment 514 of the vehicle 500 as it interacts with a TIE fighter 600. As illustrated, the HUD 542 illustrates both text and graphics relating to the interaction with the TIE fighter. The TIE fighter has an LED array 602, photo sensors 604, and one or more smoke units 606. When a passenger in the X-wing 500 fires a laser pistol 556*a* at one of the photo sensors 604, the LED array 602 glows and smoke is emitted from the TIE fighter simulating damage. Sound effects also accompany laser fire and "hit". The amount of damage to the vehicles is illustrated on the HUD.

Figure 10:
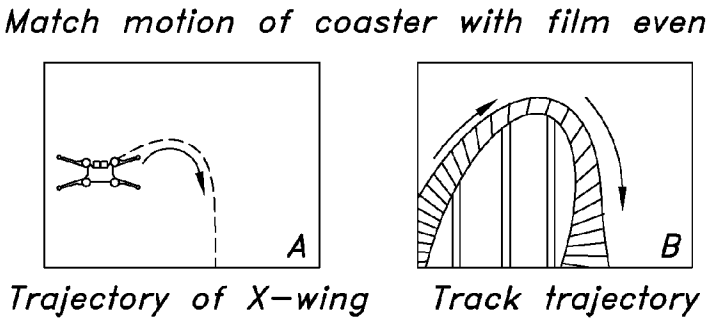
FIG. 10 illustrates how the trajectory of a flying vehicle is simulated by track design.

FIG. 10 illustrates an X-wing maneuver as seen in the film (A) and how roller coaster track (B) can be arranged to simulate the same trajectory. Most object motions found in the STAR WARS (and other) films can be replicated by designing the track in such a way as to match the motion portrayed in the film. The track configuration (B) matches the original film footage of the X-Wing turning over and taking a dive.

Figure 11:
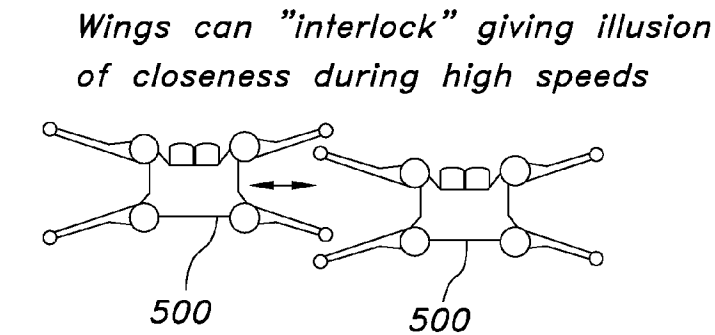
FIG. 11 illustrates how two or more vehicles are made to fly in apparently very close proximity.

FIG. 11 illustrates how vehicle design can be used to give the illusion of vehicles being closer than they really are. The shape of the X-wing vehicles allow them to "interlock" with each other, with each vehicle's exterior coming very close to the other. This interlocking relationship can be done at any point during the ride where two or more X-wings are traveling in formation. The more often it happens, the closer and more intense the ride will be.

Figure 12:
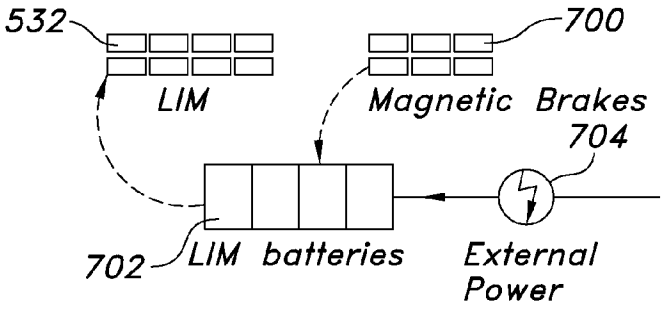
FIG. 12 is a schematic illustration of motor battery recharging system.

FIG. 12 is a schematic illustration showing how power from LECB (linear eddy current brakes) 700 can be recycled. As illustrated, the LIM launch motors 532 are powered by batteries 702 which charged by electric utility power 704. In order to reduce the cost of electricity from the utility, power generated by the LECB brakes 700 is also used to charged the batteries 702.

Figure 14:
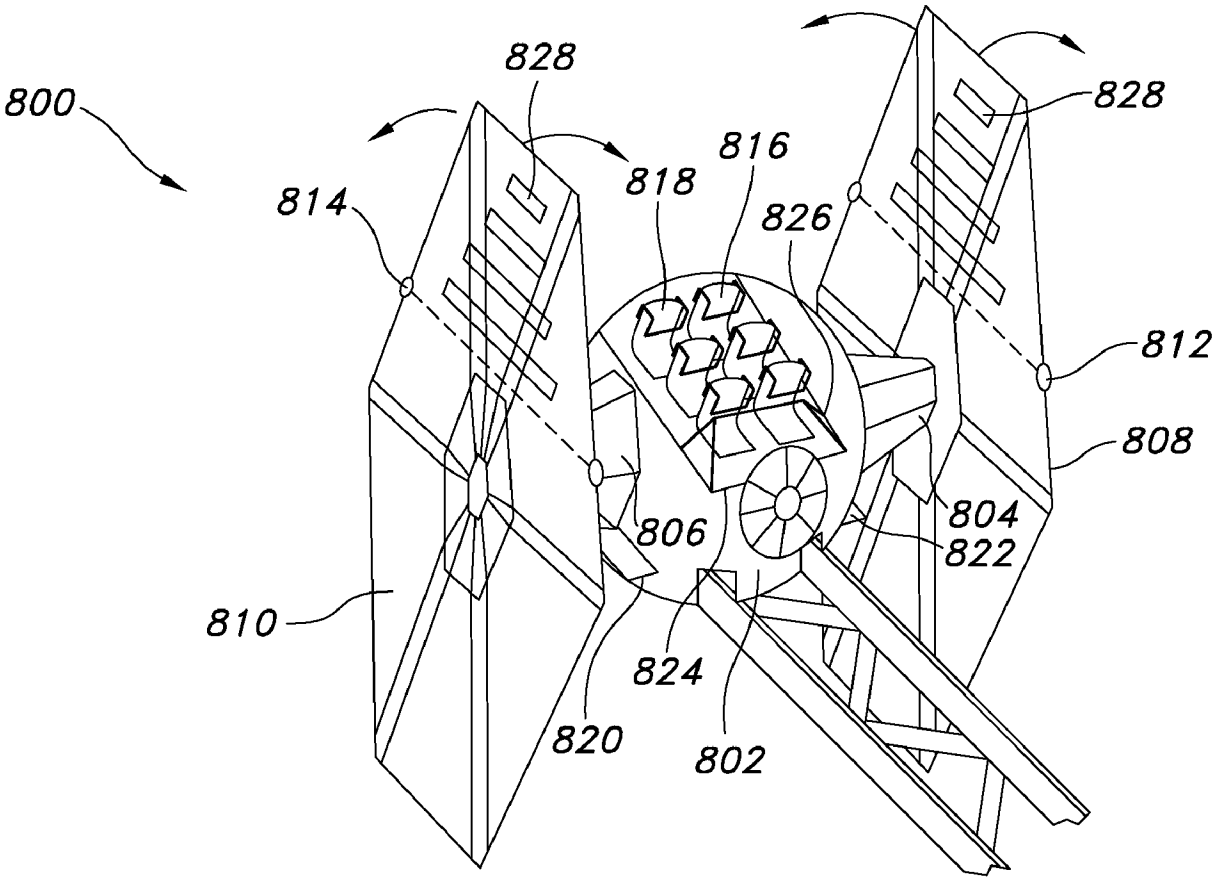
FIG. 14 is a view similar to FIG. 5 of a TIE fighter vehicle according to the illustrated embodiment.

FIG. 14 illustrates a "TIE Fighter" roller coaster vehicle 800 according to an embodiment of the invention. Functionally, the vehicle 800 is substantially the same as the vehicle 500 described in FIGS. 5-9. Visually, the vehicle 800 has a substantially spherical (or cylindrical with hemispherical ends) body 802, two outstretched arms 804, 806 and a pair of substantially parallel hexagonal "wings" 808, 810. The body 802 contains a plurality of seats 816 (six seats are illustrated) and each seat is provided with an OTSR 818. Two LIM fins 820, 822 extend outward from the bottom of the body. An HUD is arranged at the font of the body and a laser pistol 826 is provided next to each seat. The upper portions of the wings 808, 810 have hinges 812, 814 which allow a portion of each wing to fold down to provide a walk-on walk-off platform with anti-slip material 828.

Figure 15:
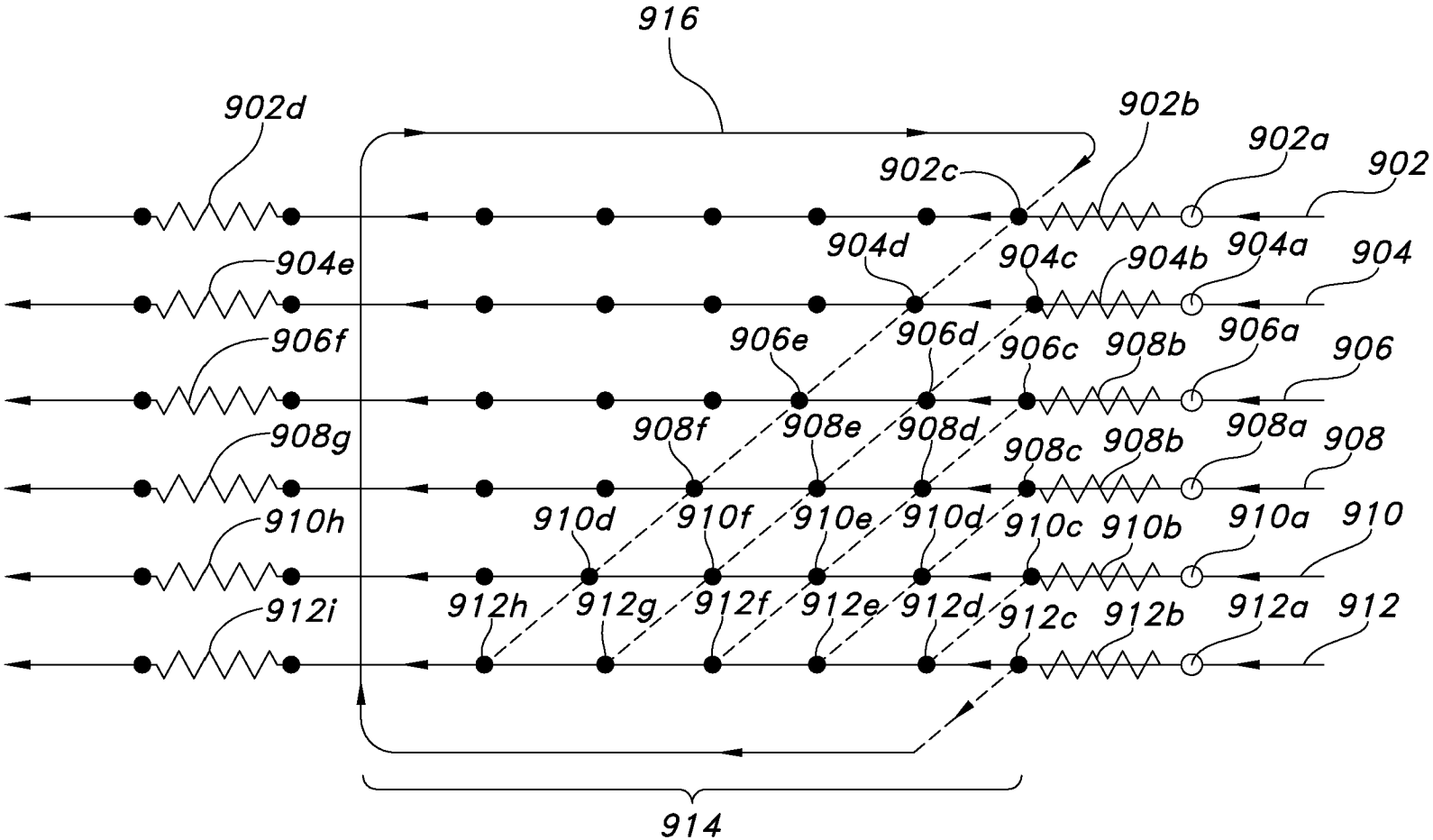
FIG. 15 is a schematic diagram illustrating a first embodiment of a loading platform switch system according to the invention.
Figure 16:
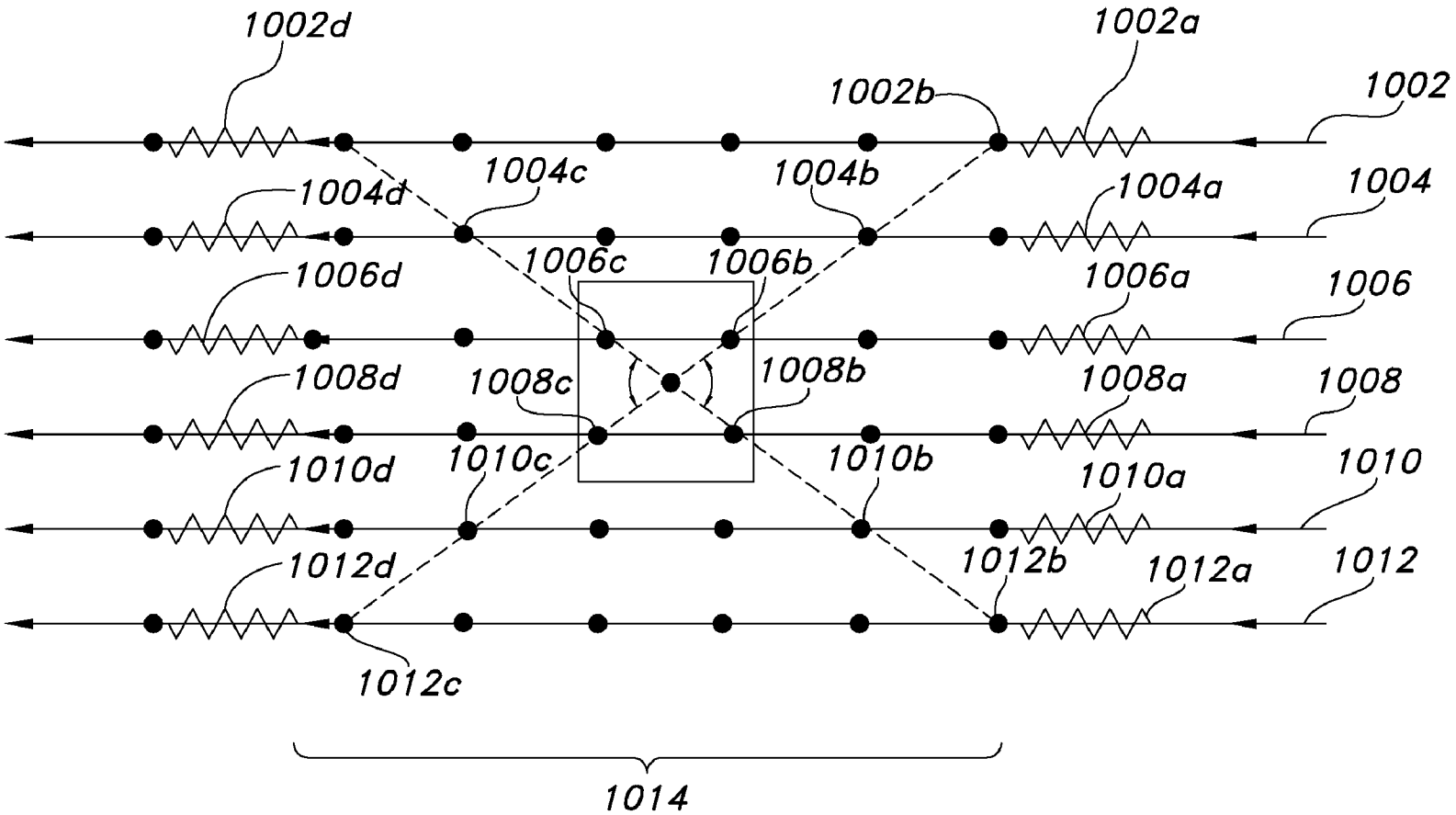
FIG. 16 is a schematic diagram illustrating a second embodiment of a loading platform switch system according to the invention.
Figure 17:
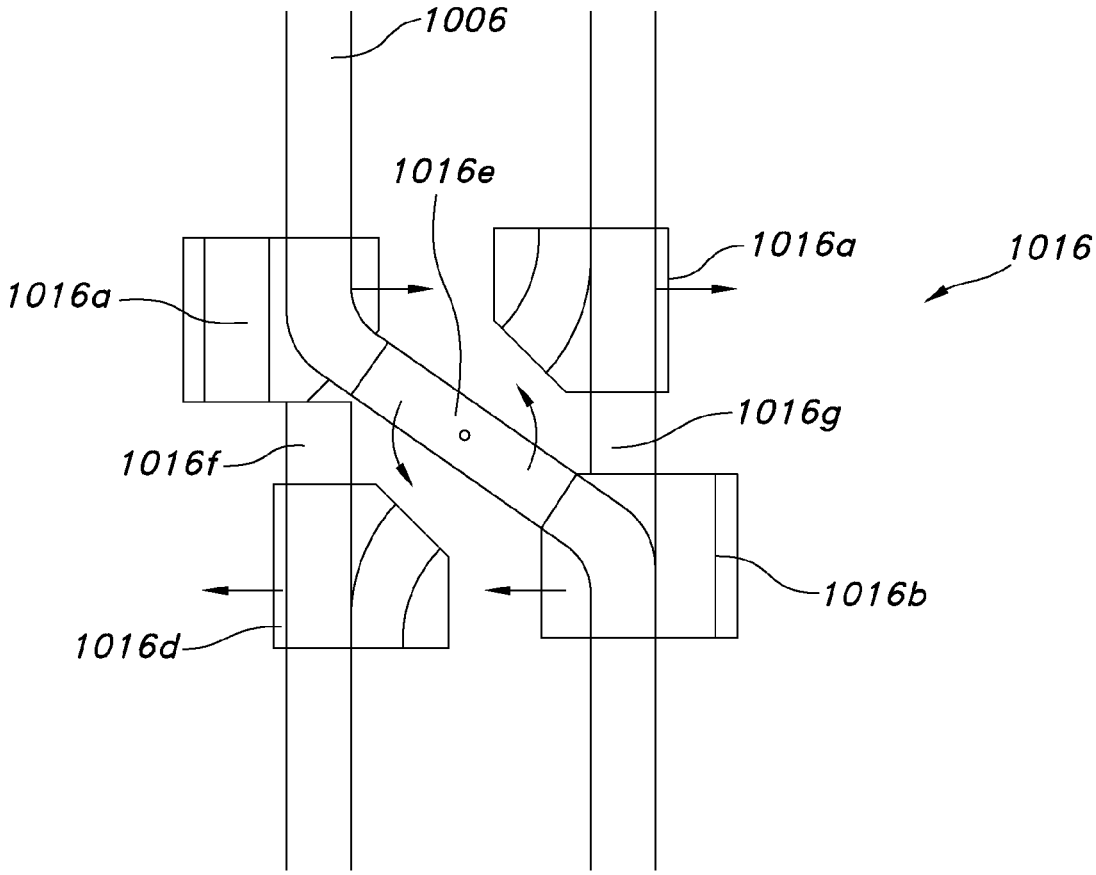
FIG. 17 is a schematic diagram of inner workings of a center bi-directional coaster switch.

FIGS. 15-17 illustrate some details of loading station switch systems. The purpose of these systems is to route vehicles to different loading stations after unloading. The reason for doing this relates to the possibility that one or a few vehicles might be deemed by riders to be more desirable than the others. In that situation, if the more desirable vehicle(s) consistently arrive at the same loading station, the queue for that station will be unreasonably long. The switching system of the invention randomly or pseudo-randomly assigns the desirable vehicles to different loading stations after each ride is unloaded.

FIG. 15 schematically illustrates six roller coaster tracks 902, 904, 906, 908, 910, 912 and a switching grid 914 for substantially simultaneous switching. Each of the tracks is provided with a sensor 902*a*, 904*a*, 906*a*, 908*a*, 910*a*, 912*a* and a brake 902*b*, 904*b*, 906*b*, 908*b*, 910*b*, 912*b* upstream of the switching grid 914. The switching grid includes an increasing number of sequential switches in each of the six tracks. The first track includes a first double switch 902*c* selectively connecting it to the next track 904 and to a track 916 described in more detail below. The track 904 has two switches 904*c* and 904*d* selectively connecting it to the next track 906. Switch 904*d* is a double switch which also selectively couples track 904 to the switch 902*c* in track 902. The track 906 has three switches 906*c*, 906*d*, 906*e* selectively connecting it to the next track 908. Switches 906*d* and 906*e* are double switches which also selectively couple the track 906 to the switches 904*c* and 904*d* in track 904. The track 908 has four switches 908*c*, 908*d*, 908*e*, 908*f* selectively connecting it to the next track 910. Switches 908*d*, 908*e*, and 908*f* are double switches which also selectively couple the track 908 to switches 906*c*, 906*d*, and 906*e* in track 906. The track 910 has five switches 910*c*, 910*d*, 910*e*, 910*f*, and 910*g*. The switches

910*d*, 910*e*, 910*f*, and 910*g* are double switches which also selectively couple the track 910 to the switches 908*c*, 908*d*, 908*e*, 908*f* in track 908. The track 912 has six switches 912*c*, 912*d*, 912*e*, 912*f*, 912*g*, and 912*h*. The switch 912*c* selectively couple the track 912 to a loop around track 916 which is coupled to the double switch 902*c* in track 902. The switch 912*h* is a double switch which selectively couples track 912 with switch 910*g* in track 910 and with the loop around track 916. The remaining switches are single switches which couple the track 912 with switches in track 910.

The switches operate in two positions, one position where the vehicle continues straight along the track and a second position where the vehicle is routed diagonally to the next sequential switch in the adjacent track. This is shown in FIG. 15 by the diagonal dashed lines. For example, if a vehicle traveling on track 902 is switched to track 904, it arrives at the second switch in track 904 where it can either continue on track 904 or be switched to track 906. When it arrives at track 906, it arrives at the third switch in track 906 where it can continue on track 906 or be switched to track 908. It will be appreciated that in this manner vehicles on any track can be switched to any adjacent track in ascending track order. In order to switch a vehicle to a track with a lower track number, a loop around track 916 is provided which connects the first and last switches in track 912 with the first switch in track 902. Those skilled in the art will appreciate that the switch 912*c* may be eliminated in some circumstances As vehicles approach the switch grid 914, they pass a sensor 902*a*, 904*a*, 906*a*, 908*a*, 910*a*, 912*a* on each track and then are braked by holder brakes 902*b*, 904*b*, 906*b*, 908*b*, 910*b*, 912*b*. Based on sensor readings, switches are toggled and the brakes are released. Kicker tires on the tracks under the cars move the vehicles forward. Depending on which switches are switched the vehicles may be released simultaneously in which case switch 912*c* may be necessary. Otherwise, the controller can determine what order to release the vehicles and the switch 912*c* is redundant of switch 912*h*. After passing through the switch grid, the vehicles are preferably braked at 902*d*, 904*e*, 906*f*, 908*g*, 910*h*, 912*i* prior to proceeding to the station so that they all arrive substantially simultaneously.

After boarding, the vehicles optionally pass through a second switching system which assures that the vehicles travel on the proper track. It will be recalled that (in at least some embodiments) the tracks are arranged to a choreography and the different vehicles need to be on the right tracks for this choreography to play properly.

From the foregoing, those skilled in the art will appreciate that the switching system of FIG. 15 could be modified so that there is only one switch per track, i.e. 902*c*, 904*d*, 906*e*, 908*f*, 910*g*, and 912*h* provided the vehicles are switched sequentially rather than simultaneously.

FIGS. 16 and 17 illustrate a second embodiment of a switch system according to the invention. FIG. 16 illustrates six coaster tracks 1002, 1004, 1006, 1008, 1010, and 1012. Each track is provided with a brake 1002*a*, 1004*a*, 1006*a*, 1008*a*, 1010*a*, and 1012*a* before entering the switch grid 1014. All of the tracks are provided with two switches each 1002*b*, 1002*c*, 1004*b*, 1004*c*, 1006*b*, 1006*c*, 1008*b*, 1008*c*, 1010*b*, 1010*c*, 1012*c* and 1012*d*. The tracks 1006 and 1008 also share a central bidirectional switch 1016 which is described in more detail below with reference to FIG. 17.

Switch 1002*b* selectively directs a vehicle from track 1002 to track 1004 where it can continue on track 1004 or be directed by switches 1004*b*, 1006*b* to track 1006. It can then continue on track 1006 or be switched to track 1008 by the bidirectional switch 1016. Once on track 1008, it can be switched by switch 1008*c* to track 1010. It can continue on track 1010 or be switched by switch 1010*c* to track 1012. It will be appreciated that the same process can be used to switch a vehicle from track 1012 to track 1002 or any other track.

Turning now to FIG. 17, the bidirectional switch 1016 has four sliding plates 1016*a*, 1016*b*, 1016*c*, 1016*d*, a rotating track segment 1016*e*, and a pair of track sections 1016*f* and 1016*g*. Plates 1016*a*, 1016*b*, 1016*c*, 1016*d* slide a straight or curved track section depending on whether the vehicle on track 1006 is to be switched to track 1008, the vehicle on track 1008 is to be switched to track 1006, or no switching action is to take place. When a vehicle is to be switched, the plates 1016*a* and 1019*b* or the plates 1016*c* and 1016*d* are slid to engage the curved track segments and the rotating track segment 1016*e* is rotated accordingly. When no switching is to be done the rotating track segment 1016*e* is rotated to a position substantially parallel to the tracks 1006, 1008, the sliding plates 1016*a*, 1016*b*, 1016*c*, 1016*d* are slid to align the straight track segments and the track segments 1016*f* and 1016*g* complete the couplings.

From the foregoing, those skilled in the art will appreciate that the first embodiment of the switching system can operate faster than the second embodiment, but the second embodiment requires fewer switches.

There have been described and illustrated herein several embodiments of a multi-track, multi-vehicle roller coaster. While particular embodiments of the invention have been described, it is not intended that the invention be limited thereto, as it is intended that the invention be as broad in scope as the art will allow and that the specification be read likewise. Thus, while numerous aspects of the invention have been described with reference to a single ride, it will be appreciated that numerous aspects of the invention can be used independently of each other. In addition, while a STAR WARS theme has been disclosed, it will be appreciated that other themes of competition, battle, conflict or struggle could be used as well. Some other popular themes have been mentioned in the summary of the invention. Thus, for example, in the Harry Potter theme, the roller coaster ride might simulate a "Quiddich" match, with each car shaped as a broomstick. The cars could utilize heads up displays with holographic projections. Thus, for example, for the "Harry Potter" car and the "Draco Malfoy" car, the "Golden Snitch" could be projected on the HUD to make the ride appear to more closely correspond to the movie. Other cars could have "Bludgers" appear on their HUDs. Other imaging techniques may likewise be used to make the Golden Snitch and/or Bludgers appear to fly close to the car. In the Quidditch roller coaster ride, riders might score goals by utilizing laser guns to shoot at a goal target, and the score of each team may be displayed as previously described. Also, the scenery of the Quidditch coaster might utilize a large warehouse which could be themed to look like an outdoor stadium. The ceiling could be designed to look like the sky, the ground to look like grass, etc. The track could be camouflaged so that the track near the grass would be green to blend in with the scenery, and the track near the sky would be blue to likewise blend in with the scenery. It is noted that some themes, including the STAR WARS used herein as an example (as well as the HARRY POTTER theme) may require a license from the trademark/copyright owner.

Further, while the invention was described as including three roller coaster tracks for each of two teams, it will be appreciated that two tracks could be used for each of two teams, or four or more tracks could be used per team. Also, three or more tracks could be used without teams. Furthermore, while the invention was described as having a single car on each track seating a plurality of individuals, it will be appreciated that each track could accommodate a train of cars, each seating one or more individuals. Also, while the invention was described as having interactive elements such as pistols and photo-detectors, it will be appreciated that those elements can be utilized to track points for each individual, car, and/or team, and that statistics for the individual, car, and/or team may be displayed at the end of the ride and/or during the ride, and a winning team and/or car declared. Further, it will be appreciated that in order to guarantee a reasonably equal distribution of riders on the different tracks, a series of switch tracks may be used between the unloading station and the loading station to enable each car to have its location switched. The switching may be random. A series of switch tracks after the loading station would then be utilized so that the cars randomly appearing on different tracks can be reordered for launch. It will therefore be appreciated by those skilled in the art that yet other modifications could be made to the provided invention without deviating from its spirit and scope as claimed.

What is claimed is:

1. A roller coaster ride comprising:

a plurality of coaster vehicles on a plurality of coaster tracks having ups and downs and tortuous paths, each of said plurality of coaster vehicles travelling by the force of gravity along much of its respective coaster track and equipped with light sensors; and scenery associated with said ride, said scenery housing a waiting path for individuals desiring to ride said roller coaster ride and housing light emitting equipment for use by said individuals to interact with said plurality of coaster vehicles by shooting light at said light sensors with said light emitting equipment to cause said sensors on said plurality of coaster vehicles to sense that they have been hit by the light while said coasters are moving on their coaster tracks.

2. A roller coaster ride according to claim 1, wherein:

said coaster vehicles and/or said scenery visually simulate a theme of competition, struggle or conflict.

3. A roller coaster ride according to claim 2, wherein:

said theme involves flying vehicles.

4. A roller coaster ride according to claim 1, wherein:

said coaster tracks are arranged such that two coaster vehicles pass in close proximity to a third coaster vehicle, the third coaster vehicle travelling in an opposite direction of the two vehicles.

5. A roller coaster ride according to claim 1, wherein:

at least one given coaster vehicle has a heads up display that displays information relating to interaction between the given coaster vehicle and at least one other coaster vehicle.

6. A roller coaster ride according to claim 1, wherein:

at least a portion of at least one coaster track is camouflaged to blend in with the scenery.

7. A roller coaster ride according to claim 1, wherein:

each of said plurality of coaster vehicles includes light emitting equipment and a sensor, wherein light emitted from said light emitting equipment on a first of said plurality of coaster vehicles causes said sensor on a second of said plurality of coaster vehicles to sense that it has been hit by said light while said second coaster is moving on its coaster track, and light emitted from said light emitting equipment on said second of said plurality of coaster vehicles causes said sensor on said first of said plurality of coaster vehicles to sense that it has been hit by said light while said first coaster is moving on its coaster track.

8. A roller coaster ride, comprising:

two vehicles on two tracks, said two vehicles each having radially extending members, said two tracks being closely horizontally adjacent but slightly vertically removed from each other such that distal portions of said members of each of said vehicles overlap one another in a vertical plane passing through said distal portions of said members.

9. A roller coaster ride according to claim 8, wherein:

said two vehicles are traveling in the same direction when said distal portions of said members overlap one another.

10. A roller coaster ride according to claim 8, wherein:

said two vehicles are traveling in opposite directions when said distal portions of said members overlap one another.

11. A roller coaster ride according to claim 8, wherein:

said two vehicles are simulations of vehicles featured in a story from mythology, history, literature or cinema.

12. A roller coaster ride according to claim 11, wherein:

said two vehicles are simulations of flying vehicles.

* * * * *